US007555239B2

(12) United States Patent
Ito et al.

(10) Patent No.: US 7,555,239 B2
(45) Date of Patent: Jun. 30, 2009

(54) IMAGE FORMING DEVICE AND FIXING UNIT

(75) Inventors: Terumasa Ito, Aichi-ken (JP); Tomitake Aratachi, Nagoya (JP); Takahiro Ikeno, Owariasahi (JP); Masatoshi Shiraki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/212,392

(22) Filed: Sep. 17, 2008

(65) Prior Publication Data

US 2009/0022515 A1 Jan. 22, 2009

Related U.S. Application Data

(62) Division of application No. 11/178,675, filed on Jul. 12, 2005, now Pat. No. 7,437,096.

(30) Foreign Application Priority Data

Jul. 12, 2004 (JP) ..... 2004-204655
Sep. 30, 2004 (JP) ..... 2004-285845
Jul. 5, 2005 (JP) ..... 2005-195948
Jul. 5, 2005 (JP) ..... 2005-195949

(51) Int. Cl.
*G03G 15/16* (2006.01)

(52) U.S. Cl. ..... 399/122; 399/124

(58) Field of Classification Search ..... 399/122, 399/124

See application file for complete search history.

(56) References Cited

U.S. PATENT DOCUMENTS 4,760,411 A 7/1988 Ohmura et al.
4,806,970 A 2/1989 Nakatomi et al.

(Continued)

FOREIGN PATENT DOCUMENTS

EP 1617301 A3 9/2006

(Continued)

OTHER PUBLICATIONS

Partial EP Search Report dtd Nov. 6, 2006, EP Appln. 05015036.6-1240.

(Continued)

*Primary Examiner*—David M Gray
*Assistant Examiner*—Bryan P Ready
(74) *Attorney, Agent, or Firm*—Banner & Witcoff, Ltd.

(57) ABSTRACT

A fixing unit is disposed at a position closer to a rear side wall than to a front side wall of a casing. A top wall is formed with a depressed portion depressed toward inside the casing. The depressed portion serves as a sheet discharge tray for receiving a recording medium that has passed through the fixing unit. The sheet discharge tray includes a tray member detachably disposed at the top wall. The rear side wall is formed with an opening through which the fixing unit is removed. When the tray member is disposed at the top wall, the tray member is positioned above and adjacent to the fixing unit and overlaps the fixing unit when viewed through the opening, thereby preventing the fixing unit from being removed from the casing. The fixing unit is removable through the opening when the tray member is detached from the top wall.

34 Claims, 21 Drawing Sheets

U.S. PATENT DOCUMENTS

| | | | | |
|---|---|---|---|---|
| 5,206,682 | A | 4/1993 | Yamada et al. | |
| 5,579,098 | A | 11/1996 | Nogushi et al. | |
| 6,314,256 | B1 * | 11/2001 | Saitoh | 399/122 |
| 6,549,740 | B2 | 4/2003 | Yoneda et al. | |
| 7,085,504 | B2 * | 8/2006 | Matsuyama et al. | 399/21 |
| 2003/0049047 | A1 * | 3/2003 | Suzuki et al. | 399/124 |
| 2003/0227533 | A1 | 12/2003 | Yokoi | |

FOREIGN PATENT DOCUMENTS

| | | | |
|---|---|---|---|
| JP | 04095985 | A | 3/1992 |
| JP | 5-197302 | A | 8/1993 |
| JP | 7-072757 | A | 3/1995 |
| JP | 7-210023 | | 8/1995 |
| JP | 8-305205 | | 11/1996 |
| JP | 11296050 | A | 10/1999 |
| JP | 2001-159856 | A | 6/2001 |
| JP | 2001206562 | A | 7/2001 |
| JP | 2002214925 | A | 7/2002 |
| JP | 2003-287973 | A | 10/2003 |
| JP | 2004-184515 | A | 7/2004 |

OTHER PUBLICATIONS

Extended EP Search Report dtd Mar. 22, 2007, EP Appln. 05015036.6-1240.

JP Office Action dtd Jul. 24, 2007, JP Appln. 2007-127658.

JP Examiner's Statement dtd Dec. 9, 2008, JP Appeal 2007-31298 (JP Appln. 2007-127658), partial translation.

* cited by examiner

IMAGE FORMING DEVICE AND FIXING UNIT

CROSS REFERENCE TO RELATED APPLICATIONS

This application is a divisional of prior U.S. application Ser. No. 11/178,675, filed Jul. 12, 2005, which claims priority to JP application Nos. 2004-204655, filed Jul. 12, 2004; 2004-285845, filed Sep. 30, 2004; 2005-195948, filed Jul. 5, 2005; and 2005-195949, filed Jul. 5, 2005, the entirety of which are incorporated herein by reference.

BACKGROUND OF THE INVENTION

1. Field of the Invention

The present invention relates to an image forming device and a fixing unit.

2. Description of Related Art

Electrophotographic image forming devices, such as laser printers, are equipped with a light-emitting unit including a laser diode and the like for emitting a light beam, and a photosensitive member, the surface of which bears a uniform charge. When the surface of the photosensitive member is exposed to the light beam, electrostatic latent images are formed on the surface of the photosensitive member and the latent images are then developed into visible images with toner. Subsequently, the visible images are transferred onto a paper or other recording medium to form visible toner images on the recording medium.

However, the images transferred onto the recording medium are merely fixed to the recording medium by an electrostatic force or dispersion force and can easily come off the recording medium. Therefore, a fixing process is required to fix the visible images to the recording medium through a process of applying heat or the like.

A fixing device provided in the image forming device for fixing images using heat typically include a heating roller and a pressure roller that serve as fixing rollers. As the recording medium passes between the heating roller and the pressure roller, the toner or other developing material is sintered and coalesced by the heat from the heating roller, so as to permeate and become fixed to the recording medium. The heating roller accommodates a heat source, such as a halogen lamp. Since failure or the like of the halogen lamp is fatal to the image forming device, resulting in a loss of the fixing function, the fixing unit need to be easily replaceable. Various proposals, such as that described in Japanese patent-application publication No. HEI-8-305205, have been made for fixing units integrally configured of a heating roller, pressure roller, and the like that can easily be replaced when malfunctions occur.

Since it is convenient for users of common household printers to be able to install their printers in a small space, such as on a bookshelf, there is a large demand for compact laser printers and other image forming devices. However, in order to facilitate replacement of the fixing unit, as described above, a space inside the device through which the fixing unit can be removed must be secured, as illustrated in FIG. 8 of Japanese patent-application publication No. HEI-7-210023. This makes it difficult to reduce the sizes of devices, and particularly to reduce the height.

SUMMARY

In view of the foregoing, it is an object of the present invention to provide an image forming device and a fixing unit capable of being made more compact while enabling the fixing unit to be easily replaced.

In order to attain the above and other objects, according to one aspect, the present invention provides an image forming device. The image forming device includes a casing, a process cartridge, a scanning unit, and a fixing unit. The casing has a top wall and side walls. The side walls include a front side wall and a rear side wall opposite to each other. The top wall is positioned at a top of the casing when the casing is disposed in an orientation in which the casing is intended to be placed. The process cartridge includes an image bearing member that bears a toner image thereon. The scanning unit exposes the image bearing member to scanned light. The fixing unit includes a fixing roller that extends in an axial direction and that fixes the toner image transferred from the image bearing member onto a recording medium. The front side wall and the rear side wall each extends in a direction substantially parallel to the axial direction. The fixing unit is disposed at a position closer to the rear side wall than to the front side wall. The top wall is formed with a depressed portion depressed toward inside the casing. The depressed portion serves as a sheet discharge tray for receiving the recording medium that has passed through the fixing unit. The sheet discharge tray includes a tray member detachably disposed at the top wall. The rear side wall is formed with an opening through which the fixing unit is removed. When the tray member is disposed at the top wall, the tray member is positioned above and adjacent to the fixing unit and overlaps the fixing unit when viewed through the opening, thereby preventing the fixing unit from being removed from the casing. The fixing unit is removable through the opening when the tray member is detached from the top wall.

According to another aspect, the present invention provides a fixing unit. The fixing unit includes a heating roller, a pressure roller, a unit cover, a pair of support members, and an urging member. The heating roller heat-fixes a toner image that has been transferred onto a recording medium. The heating roller has longitudinal ends. The pressure roller is disposed in contact with the heating roller and presses the recording medium against the heating roller. The pressure roller has longitudinal ends. The unit cover covers at least part of the heating roller and rotatably supports the longitudinal ends of the heating roller. The pair of support members rotatably supports the longitudinal ends of the pressure roller. One end of each support member is pivotally supported by the unit cover such that at least part of the pressure roller is exposed without being covered by the unit cover. The urging member has one end and another end. The one end is connected with the unit cover and the other end is connected with a side of the support member. The side of the support member is opposite the one end with respect to a rotational axis of the pressure roller. The pressure roller is urged toward the heating roller by an urging force of the urging member.

According to another aspect, the present invention provides an image forming device. The image forming device includes a casing, a process cartridge, a scanning unit, and a fixing unit. The casing has a top wall and side walls. The side walls include a front side wall and a rear side wall opposite to each other. The top wall is positioned at a top of the casing when the casing is disposed in an orientation in which the casing is intended to be placed. The process cartridge includes an image bearing member that bears a toner image thereon. The scanning unit exposes the image bearing member to scanned light. The fixing unit includes a fixing roller that extends in an axial direction and that fixes the toner image transferred from the image bearing member onto a recording medium. The front side wall and the rear side wall each extends in a direction substantially parallel to the axial direction. The fixing unit is disposed at a position closer to the rear side wall than to the front side wall. The top wall is formed with a depressed portion depressed toward inside the casing. The depressed portion serves as a sheet discharge tray for receiving the recording medium that has passed through the fixing unit. The sheet discharge tray is positioned above the fixing unit. The sheet discharge tray includes a tray member formed integrally with the fixing unit to form a combined unit. The rear side wall is formed with an opening through which the fixing unit is removed. The combined unit is removable from the casing through the opening.

According to another aspect, the present invention provides an image forming device. The image forming device includes a casing, a process cartridge, a scanning unit, and a fixing unit. The casing has a top wall and side walls. The side walls include a front side wall and a rear side wall opposite to each other. The top wall is positioned at a top of the casing when the casing is disposed in an orientation in which the casing is intended to be placed. The process cartridge includes an image bearing member that bears a toner image thereon. The scanning unit exposes the image bearing member to scanned light. The fixing unit includes a fixing roller that extends in an axial direction and that fixes the toner image transferred from the image bearing member onto a recording medium. The front side wall and the rear side wall each extends in a direction substantially parallel to the axial direction. The fixing unit is disposed at a mount position closer to the rear side wall than to the front side wall. The top wall is formed with a depressed portion depressed toward inside the casing. The depressed portion serves as a sheet discharge tray for receiving the recording medium that has passed through the fixing unit. The rear side wall is formed with an opening through which the fixing unit is removed. The fixing unit is removed from the casing along a fixing unit removing passage. The fixing unit removing passage is provided in the casing from the mount position to the opening. The sheet discharge tray includes a tray member movable between a first position and a second position. The first position is a position at which at least part of the tray member is positioned in the fixing unit removing passage, thereby preventing the fixing unit from being removed from the casing. The second position is a position at which the tray member is positioned outside the fixing unit removing passage, thereby allowing the fixing unit to be removed from the casing along the fixing unit removing passage.

According to another aspect, the present invention provides a method for removing a fixing unit from an image forming device. The image forming device includes a casing, a process cartridge, a scanning unit, and a fixing unit. The casing has a top wall and side walls. The side walls include a front side wall and a rear side wall opposite to each other. The top wall is positioned at a top of the casing when the casing is disposed in an orientation in which the casing is intended to be placed. The process cartridge includes an image bearing member that bears a toner image thereon. The scanning unit exposes the image bearing member to scanned light. The fixing unit includes a fixing roller that extends in an axial direction and that fixes the toner image transferred from the image bearing member onto a recording medium. The front side wall and the rear side wall each extends in a direction substantially parallel to the axial direction. The fixing unit is disposed at a position closer to the rear side wall than to the front side wall. The top wall is formed with a depressed portion depressed toward inside the casing. The depressed portion serves as a sheet discharge tray for receiving the recording medium that has passed through the fixing unit. The sheet discharge tray includes a tray member detachably disposed at the top wall. The rear side wall is formed with an opening through which the fixing unit is removed. When the tray member is disposed at the top wall, the tray member is positioned above and adjacent to the fixing unit and overlaps the fixing unit when viewed through the opening, thereby preventing the fixing unit from being removed from the casing. The method includes detaching the tray member from the top wall, and removing, after the detaching step, the fixing unit from the casing through the opening.

According to another aspect, the present invention provides a method for removing a fixing unit from an image forming device. The image forming device includes a casing, a process cartridge, a scanning unit, and a fixing unit. The casing has a top wall and side walls. The side walls include a front side wall and a rear side wall opposite to each other. The top wall is positioned at a top of the casing when the casing is disposed in an orientation in which the casing is intended to be placed. The process cartridge includes an image bearing member that bears a toner image thereon. The scanning unit exposes the image bearing member to scanned light. The fixing unit includes a fixing roller that extends in an axial direction and that fixes the toner image transferred from the image bearing member onto a recording medium. The front side wall and the rear side wall each extends in a direction substantially parallel to the axial direction. The fixing unit is disposed at a position closer to the rear side wall than to the front side wall. The top wall is formed with a depressed portion depressed toward inside the casing. The depressed portion serves as a sheet discharge tray for receiving the recording medium that has passed through the fixing unit. The sheet discharge tray is positioned above the fixing unit. The sheet discharge tray includes a tray member formed integrally with the fixing unit to form a combined unit. The rear side wall is formed with an opening through which the fixing unit is removed. The method includes removing the combined unit from the casing through the opening.

According to another aspect, the present invention provides a method for removing a fixing unit from an image forming device. The image forming device includes a casing, a process cartridge, a scanning unit, and a fixing unit. The casing has a top wall and side walls. The side walls include a front side wall and a rear side wall opposite to each other. The top wall is positioned at a top of the casing when the casing is disposed in an orientation in which the casing is intended to be placed. The process cartridge includes an image bearing member that bears a toner image thereon. The scanning unit exposes the image bearing member to scanned light. The fixing unit includes a fixing roller that extends in an axial direction and that fixes the toner image transferred from the image bearing member onto a recording medium. The front side wall and the rear side wall each extends in a direction substantially parallel to the axial direction. The fixing unit is disposed at a mount position closer to the rear side wall than to the front side wall. The top wall is formed with a depressed portion depressed toward inside the casing. The depressed portion serves as a sheet discharge tray for receiving the recording medium that has passed through the fixing unit. The rear side wall is formed with an opening through which the fixing unit is removed. The fixing unit is removed from the casing along a fixing unit removing passage. The fixing unit removing passage is provided in the casing from the mount position to the opening. The sheet discharge tray includes a tray member movable between a first position and a second position. The first position is a position at which at least part of the tray member is positioned in the fixing unit removing passage, thereby preventing the fixing unit from being removed from the casing. The second position is a position at which the tray member is positioned outside the fixing unit removing passage, thereby allowing the fixing unit to be removed from the casing along the fixing unit removing passage. The method includes moving the tray member from the first position to the second position, and removing, after the moving step, the fixing unit from the casing through the opening.

BRIEF DESCRIPTION OF THE DRAWINGS

The above and other objects, features and advantages of the invention will become more apparent from reading the following description of the embodiments taken in connection with the accompanying drawings in which.

DETAILED DESCRIPTION OF THE EMBODIMENTS

Figure 1:
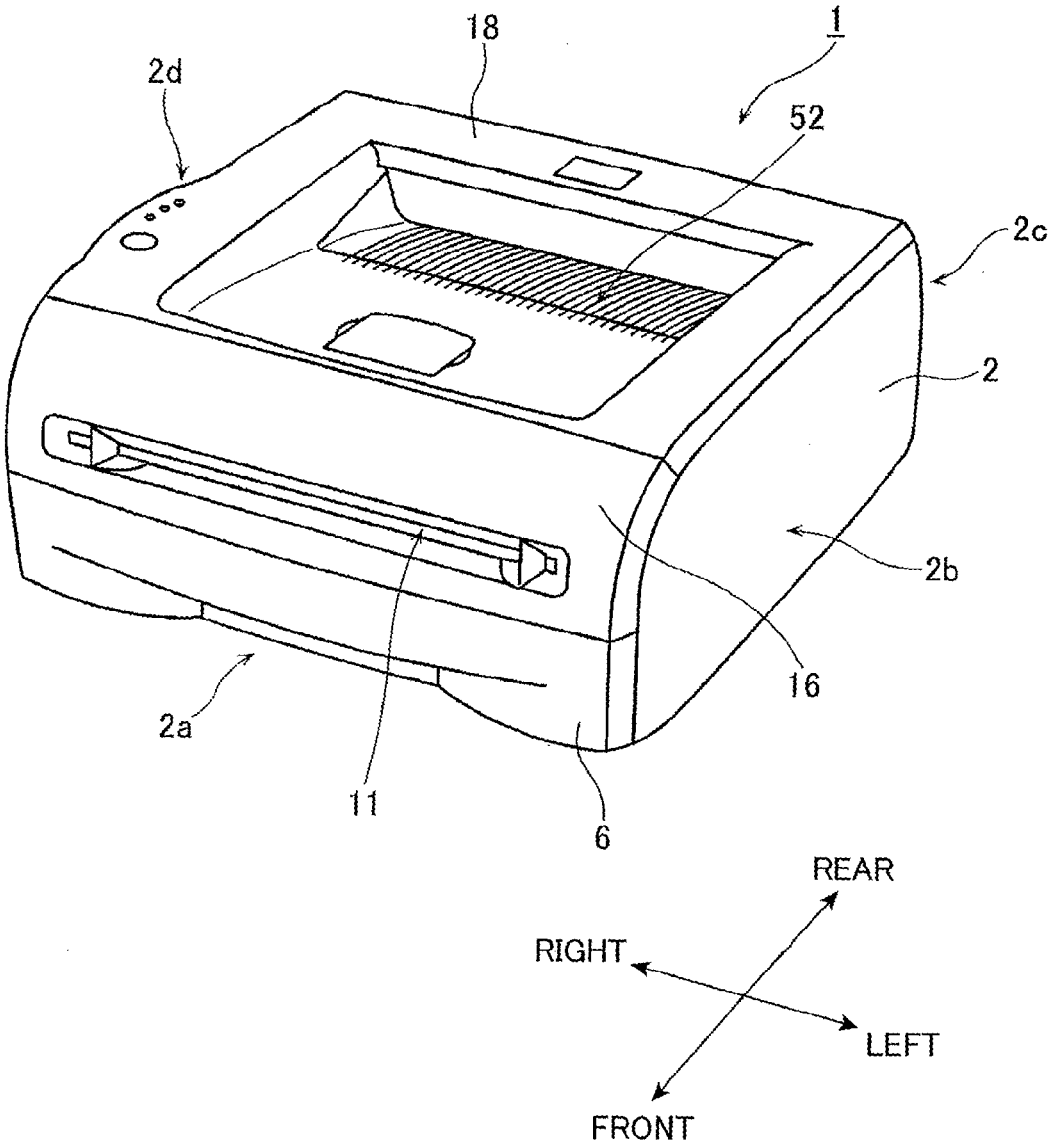
FIG. 1 is a perspective view showing a laser printer according to a first embodiment of the present invention.

An image forming device and a fixing device according to embodiments of the present invention will be described while referring to the accompanying drawings wherein like parts and components are designated by the same reference numerals to avoid duplicating description.

First Embodiment

An image forming device and a fixing device according to a first embodiment of the present invention will be described while referring to FIGS. 1 through 10.

(1) Overall Construction of a Laser Printer

FIG. 1 is a perspective view showing the exterior of a laser printer 1. As shown in FIG. 1, the laser printer 1 includes a casing 2 having a top cover 18 forming the top wall of the casing 2, and four side walls 2*a*, 2*b*, 2*c*, and 2*d* including front side wall 2*a* and rear side wall 2*c* (side walls 2*c* and 2*d* are not visible in FIG. 1). A portion of the top cover 18 is depressed (recessed) toward inside the casing 2 to form a sheet discharge tray 52. A paper supply cassette 6 is provided in the bottom section of the casing 2 and can be inserted into or removed from the casing 2 via the front side wall 2*a*. The paper supply cassette 6 can accommodate a plurality of sheets of a paper or other recording medium. The front side wall 2*a* also includes a front cover 16 that is swingably open or closed on the front of the casing 2, and a manual feed tray 11 disposed on the front cover 16 for hand-feeding a recording medium one sheet at a time.

Figure 2:
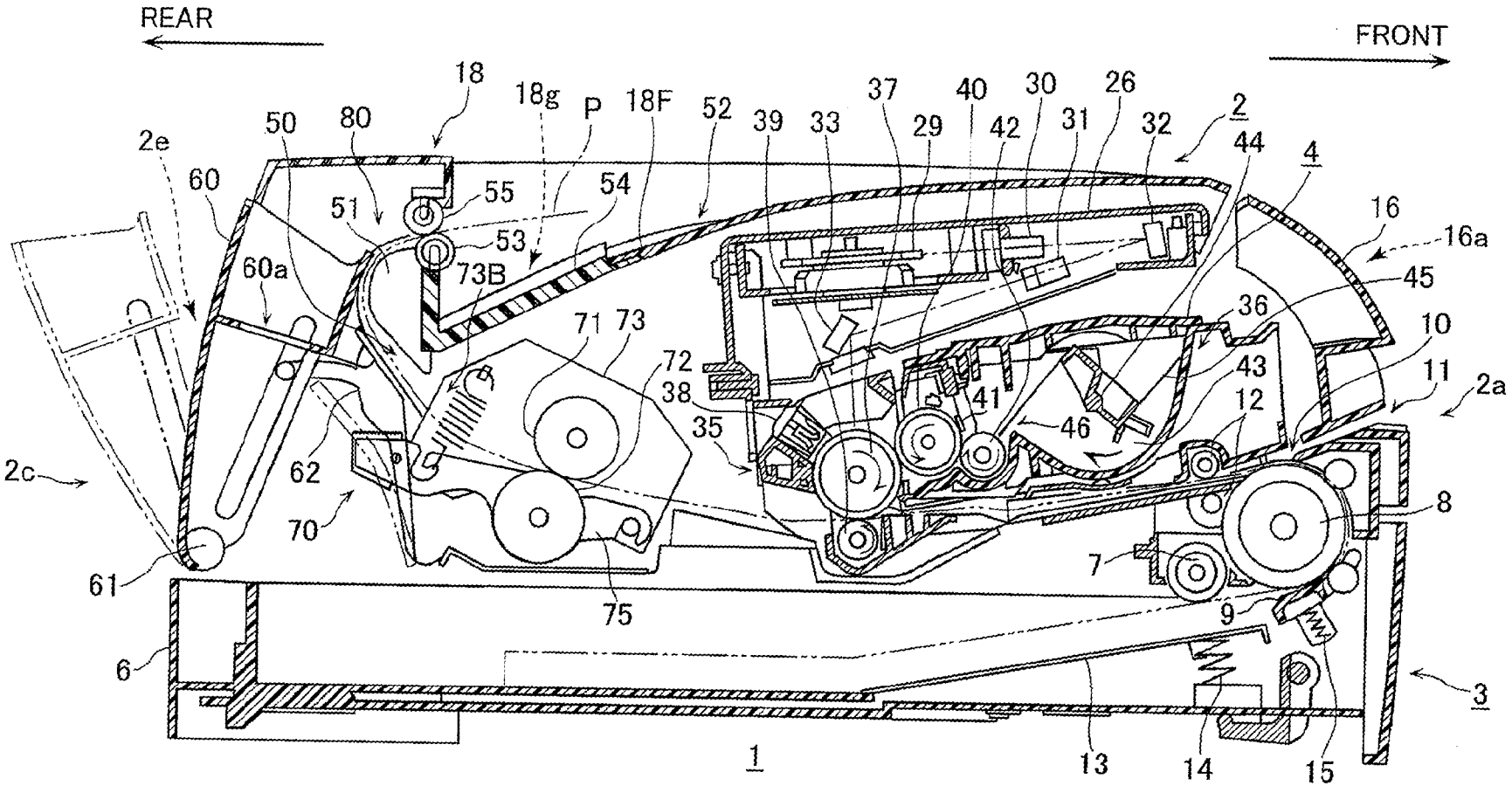
FIG. 2 is a vertical cross-sectional view of the laser printer according to the first embodiment.

Next, the construction of the laser printer 1 will be described in greater detail with reference to the FIG. 2. FIG. 2 is a vertical cross-sectional view of the laser printer 1 viewed from the side wall 2*d* side. In FIG. 2, a fixing unit 70 provided in the laser printer 1 has been simplified for illustration purposes. The laser printer 1 includes the casing 2 having the top cover 18, the front cover 16 provided on the front side wall 2*a*, and a rear cover 60 provided on the rear side wall 2*c*. Also accommodated in the casing 2 are a paper feed unit 3 for supplying a paper or other recording medium (a conveying path along which the recording medium is conveyed is represented by a two-dot chain line P); a process cartridge 4 for forming visible toner images on the paper conveyed from the paper feed unit 3; the fixing unit 70 mentioned above for fixing the toner image to the paper; and a paper discharge unit 80 for discharging the paper after the paper has passed through the fixing unit 70. In the present embodiment, the side wall near the fixing unit 70 on the left side in FIG. 2 is the rear side wall 2*c*, while the side wall opposite the rear side wall 2*c* is the front side wall 2*a*. The front side wall 2*a* and the rear side wall 2*c* each extends in a direction substantially parallel to an axial direction of fixing rollers 71 and 72 described later.

The paper feed unit 3 includes the paper supply cassette 6; and feeding rollers 7 and 8, and a separating pad 9 disposed above the leading edge of the paper stacked in the paper supply cassette 6 with respect to the paper conveying direction (the front side of the laser printer 1). A paper feeding path 10 is formed by the paper feed unit 3 for turning the direction of the sheets of paper fed from the paper supply cassette 6 and conveying the paper along the bottom of the process cartridge 4. A pair of registration rollers 12 is provided on the paper feed unit 3 and straddle the paper feeding path 10. Whether the paper is fed onto the paper feeding path 10 from paper stacked in the paper supply cassette 6 or from a sheet hand-fed into the manual feed tray 11, the registration rollers 12 initially stops progress of the sheet of paper before supplying the sheet to an image forming unit in the process cartridge 4 at a timing synchronized with the image forming unit in the process cartridge 4.

The paper supply cassette 6 is disposed below the process cartridge 4 and the fixing unit 70 and can be inserted into and removed from the casing 2 through the front side. The paper supply cassette 6 accommodates a paper pressing plate 13 and a spring 14 disposed on the underside of the paper pressing plate 13 for urging an end of the paper pressing plate 13 nearest the feeding roller 7 upward. The paper pressing plate 13 is capable of pivoting about an end farthest from the feeding roller 7 so that the end of the paper pressing plate 13 nearest the feeding roller 7 can move up and down to accommodate sheets of a recording medium stacked on the paper feed unit 3. As the amount of paper stacked on the paper pressing plate 13 increases, the end of the paper pressing plate 13 nearest the feeding roller 7 against the urging force of the spring 14 and pivots downward about the end farthest from the feeding roller 7.

The feeding roller 8 and the separating pad 9 are disposed in confrontation with each other. A spring 15 is disposed on the underside of the separating pad 9 for urging the separating pad 9 toward the feeding roller 8. The spring 14 on the underside of the paper pressing plate 13 urges the paper pressing plate 13 so that the topmost sheet of paper stacked on the paper pressing plate 13 is pressed against the feeding roller 7. The feeding roller 7 feeds the topmost sheet to a position between the feeding roller 8 and the separating pad 9. The feeding roller 8 rotates to feed the topmost sheet onto the paper feeding path 10, while the cooperative operations of the feeding roller 8 and separating pad 9 ensure that the sheets are separated and fed one sheet at a time.

A sheet of paper supplied from the paper supply cassette 6 or the manual feed tray 11 is conveyed to the registration rollers 12 disposed above the feeding roller 7. The registration rollers 12 first register the sheet and then convey the sheet to an image forming position beneath the process cartridge 4 (a contact position between a photosensitive drum 37 and a transfer roller 39 described later). As mentioned earlier, the front cover 16 is provided on the front side wall 2*a* of the casing 2 and can be freely opened and closed on the casing 2. When the front cover 16 is in an open state, a front side opening 16*a* is revealed in the casing 2 through which the process cartridge 4 can be inserted or removed.

A scanning unit 26 is disposed above the process cartridge 4. The scanning unit 26 includes a laser light-emitting unit (not shown), a polygon mirror 29 that is driven to rotate at a high speed, a first scanning lens (f□ lens) 30, a second scanning lens (cylindrical lens) 31, and reflecting mirrors 32 and 33. The laser light-emitting unit emits a laser beam that is modulated according to image data. As indicated by a single-dot chain line in the scanning unit 26, the laser beam passes through or is reflected off the polygon mirror 29, first scanning lens 30, reflecting mirror 32, second scanning lens 31, and reflecting mirror 33 in the order given and is scanned over the surface of the photosensitive drum 37 in the process cartridge 4.

The process cartridge 4 includes a drum cartridge 35 and a developing cartridge 36. The drum cartridge 35 accommodates the photosensitive drum 37, a charger 38, a transfer roller 39, and the like. As described above, the process cartridge 4 can be mounted in and removed from the casing 2 via the front side opening 16*a* when the front cover 16 is open. The developer cartridge 36 is detachably mounted on the drum cartridge 35 and includes a developing roller 40, a thickness regulating blade 41, a supply roller 42, a toner hopper 43, and the like.

The toner hopper 43 accommodates toner. The toner hopper 43 is provided with a toner supply opening 46 formed in a side thereof and houses a rotational shaft 44 and an agitator 45 rotatably supported on the rotational shaft 44. The agitator 45 is driven to rotate in the direction of the arrow shown in FIG. 2 to agitate the toner accommodated in the toner hopper 43 so that some of the toner is discharged through the toner supply opening 46. The supply roller 42 is rotatably disposed at a position to the side of the toner supply opening 46. The developing roller 40 is rotatably disposed in confrontation with the supply roller 42 and contacts the supply roller 42 with sufficient pressure so that the developing roller 40 and supply roller 42 compress to a degree.

The developing roller 40 is configured of a metal roller shaft covered by a roller formed of an electrically conductive rubber material. The developing roller 40 is driven to rotate in the direction indicated by the arrow (counterclockwise in FIG. 2). A developing bias is applied to the developing roller 40. The thickness regulating blade 41 is disposed near the developing roller 40 and includes a main blade member configured of a metal leaf spring member, and a pressing part provided on a distal end of the main blade member. The pressing part has a semicircular cross section and is formed of an insulating silicon rubber. The thickness regulating blade 41 is supported on the developer cartridge 36 near the developing roller 40 so that the elastic force of the main blade member causes the pressing part to contact the developing roller 40 with pressure.

Toner discharged through the toner supply opening 46 is supplied to the developing roller 40 by the rotation of the supply roller 42. At this time, the toner is positively tribocharged between the supply roller 42 and the developing roller 40. As the developing roller 40 rotates, the toner supplied onto the surface of the developing roller 40 passes between the thickness regulating blade 41 and the developing roller 40, thereby maintaining a uniform thin layer of toner on the surface of the developing roller 40.

The photosensitive drum 37 is disposed in the drum cartridge 35 to the side of the developing roller 40 and can rotate in the direction indicated by the arrow (clockwise in FIG. 2) while in confrontation with the developing roller 40. The photosensitive drum 37 is configured of a main drum body that is grounded and a surface layer formed of a positive charging photosensitive layer of polycarbonate or the like.

The charger 38 is disposed diagonally above and to the rear of the photosensitive drum 37, confronting the photosensitive drum 37 but separated a predetermined distance therefrom. The charger 38 is a positive charging Scorotron charger having a charging wire formed of tungsten or the like from which a corona discharge is generated. The charger 38 functions to charge the entire surface of the photosensitive drum 37 with a uniform positive polarity.

The transfer roller 39 is disposed below the photosensitive drum 37 and in opposition thereto, and is supported in the drum cartridge 35 so as to be capable of rotating in the direction indicated by the arrow (counterclockwise in FIG. 2). The transfer roller 39 includes a metal roller shaft covered by a roller that is formed of an electrically conductive rubber material. A transfer bias is applied to the transfer roller 39 during a transfer operation.

As the photosensitive drum 37 rotates, the charger 38 charges the surface of the photosensitive drum 37 with a uniform positive polarity. Subsequently, the surface of the photosensitive drum 37 is exposed to a laser beam emitted from the scanning unit 26, forming an electrostatic latent image on the surface of the photosensitive drum 37. Next, the positively charged toner carried on the surface of the developing roller 40 is brought into contact with the photosensitive drum 37 as the developing roller 40 rotates. At this time, due to the developing bias applied to the developing roller 40, the latent image formed on the surface of the photosensitive drum 37 is developed into a toner image when the toner is selectively attracted to portions of the photosensitive drum 37 that were exposed to the laser beam and, therefore, have a lower potential than the rest of the surface having a uniform positive charge. In this way, a reverse developing process is achieved.

Subsequently, the toner image carried on the surface of the photosensitive drum 37 is transferred onto the paper due to the transfer bias applied to the transfer roller 39, as the sheet of paper passes between the photosensitive drum 37 and the transfer roller 39.

The fixing unit 70 is disposed above the paper supply cassette 6 and to the side and downstream of the process cartridge 4 with respect to the paper conveying direction. The fixing unit 70 includes a heating roller 71, and a pressure roller 72 disposed in confrontation with the heating roller 71 and urged to contact the heating roller 71 with pressure. The heating roller 71 accommodates an internal heater.

The heating roller 71 is configured of a metal cylinder accommodating a heater in the form of a halogen lamp, for example, that functions to heat the metal cylinder. The pressure roller 72 follows the rotation of the heating roller 71 while applying pressure to the same. The construction of the fixing unit 70 will be described in greater detail below.

After a visible toner image is transferred onto a sheet of paper at the process cartridge 4, the toner image is fixed to the sheet in the fixing unit 70 by the heat of the heating roller 71 as the sheet passes between the heating roller 71 and the pressure roller 72. Subsequently, the heating roller 71 and pressure roller 72 convey the sheet onto a paper discharge path 50 formed in the paper discharge unit 80.

The paper discharge unit 80 includes an inner guide member 51 and an outer guide member 62 that form the paper discharge path 50; lower discharge rollers 53 and upper discharge rollers 55 forming pairs of discharge rollers disposed in a discharge opening through which the paper is discharged onto the sheet discharge tray 52 provided on the top cover 18; and a tray member 54 constituting part of the sheet discharge tray 52. The outer guide member 62 moves in association with the opening and the closing of the rear cover 60 provided on the rear side wall 2*c* of the casing 2. The rear cover 60 is attached to the casing 2 via a hinge 61 and is capable of swinging open and closed about the hinge 61. When the rear cover 60 is swung to an open position, the top portion of the outer guide member 62 pivots rearward in association. In this way, the paper discharge path 50 can be exposed through an opening 2*e* formed in the rear side wall 2*c* by opening the rear cover 60. Heat dissipation openings 60*a* are formed in the rear cover 60 for allowing heat to be released from the fixing unit 70. Hence, heat generated from the fixing unit 70 passes through the heat dissipation openings 60*a* and escapes out of the laser printer 1 via a gap formed between the rear cover 60 and the casing 2 at a point above the heat dissipation openings 60*a*, thereby reducing the amount of heat that is trapped in the casing 2.

Figure 7:
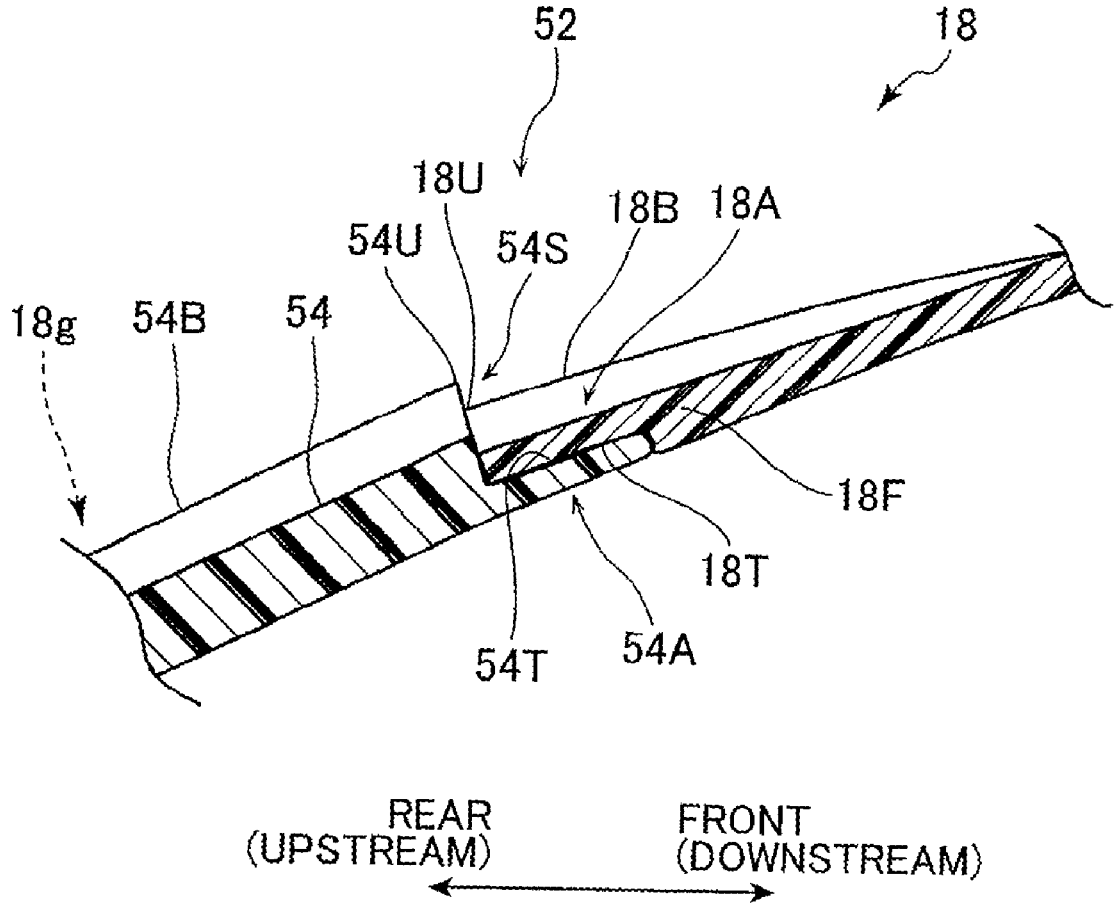
FIG. 7 is an enlarged cross-sectional view taken along a line VII-VII of FIG. 5, showing a bordering portion of the tray member and the top cover when the tray member is mounted in the top cover.

The discharge tray 52 is substantially rectangular in shape in a plan view. The rear end of the discharge tray 52 is formed as a depressed portion that is depressed toward inside the casing 2 and slopes gradually upward toward the front wall 2*a* side of the casing 2. In the present embodiment, a section of the sheet discharge tray 52 that slopes gradually upward from the rear end to a point in the middle of the sheet discharge tray 52 is configured by the tray member 54. The top surface of the tray member 54 on the front end (the downstream end in the paper conveying direction) is configured to contact the bottom surface of a fixed wall portion 18F of the top cover 18 on the rear end (the upstream end) as will be described later (FIG. 7). The construction of the sheet discharge tray 52 and the like will be described in greater detail below.

Hence, after passing through the fixing unit 70, the sheet of paper is conveyed along the paper discharge path 50. The paper discharge path 50, configured by the inner guide member 51 and the outer guide member 62, turns the direction in which the sheet is conveyed so that the sheet is directed toward the pair of discharge rollers 53 and 55. The discharge rollers 53 and 55 discharge the sheet of paper onto the sheet discharge tray 52 toward the front side wall 2*a* side of the casing 2.

(2) Detailed Construction of the Fixing Unit

Figure 3:
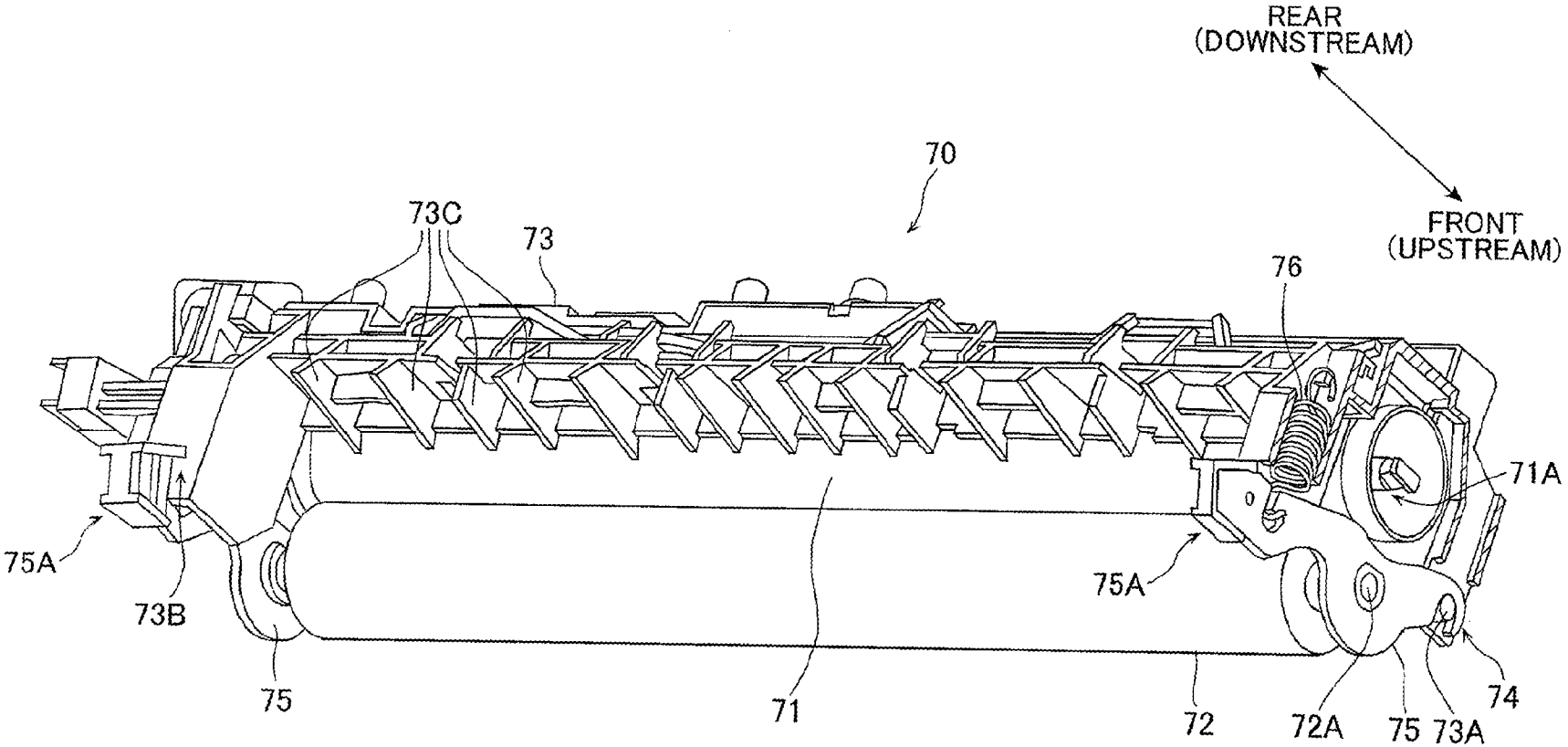
FIG. 3 is a perspective view illustrating the construction of a fixing unit provided in the laser printer.

Next, the construction of the fixing unit 70 according to the first embodiment will be described in detail. FIG. 3 is a perspective view illustrating the construction of the fixing unit 70. The fixing unit 70 according to the first embodiment includes the heating roller 71, and the pressure roller 72 disposed beneath the heating roller 71 and pressing against the surface of the same. The heating roller 71 accommodates an internal heater, such as a halogen lamp 71A.

A unit cover 73 covers the upper portion of the heating roller 71 (an end of the unit cover 73 has been cut away in FIG. 3 for illustrative purposes). The unit cover 73 is formed (molded) of a resin, such as polyethylene teraphthalate (PET). The unit cover 73 does not cover the entirety of the pressure roller 72 and, hence, part of the pressure roller 72 (a lower portion of the pressure roller 72) is exposed without being covered by the unit cover 73. With this construction, the fixing unit 70 can be made more compact, contributing to a more compact image forming device. The pressure roller 72 has a rotational shaft 72A extending through the core thereof. Both longitudinal ends of the rotational shaft 72A are rotatably supported by a pair of support levers (support members) 75. Each support lever 75 extends in the paper conveying direction and has a hook-shaped support portion 74 on the upstream end and a grip 75A provided on the downstream end with respect to the paper conveying direction. The support portion 74 engages with a support shaft 73A disposed on the unit cover 73. The support lever 75 is pivotally supported at the unit cover 73 so as to be pivotally moved about the support shaft 73A. A spring 76 has one end connected (engaged) with the unit cover 73 and another end connected with the support lever 75 on the opposite side of the rotational shaft 72A from the support portion 74 (the rear side, or the downstream side in the paper conveying direction).

The urging force (restorative force) of the spring 76 urges the pressure roller 72 toward the heating roller 71 and, hence, eliminates the need to provide an urging means below the pressure roller 72. Accordingly, it is not necessary for the unit cover 73 to cover the pressure roller 72.

When a paper jam or the like occurs in the fixing unit 70, the user of the laser printer 1 can open the rear cover 60 (FIG. 1) and press down on the grip 75A to easily resolve the problem.

Figure 4:
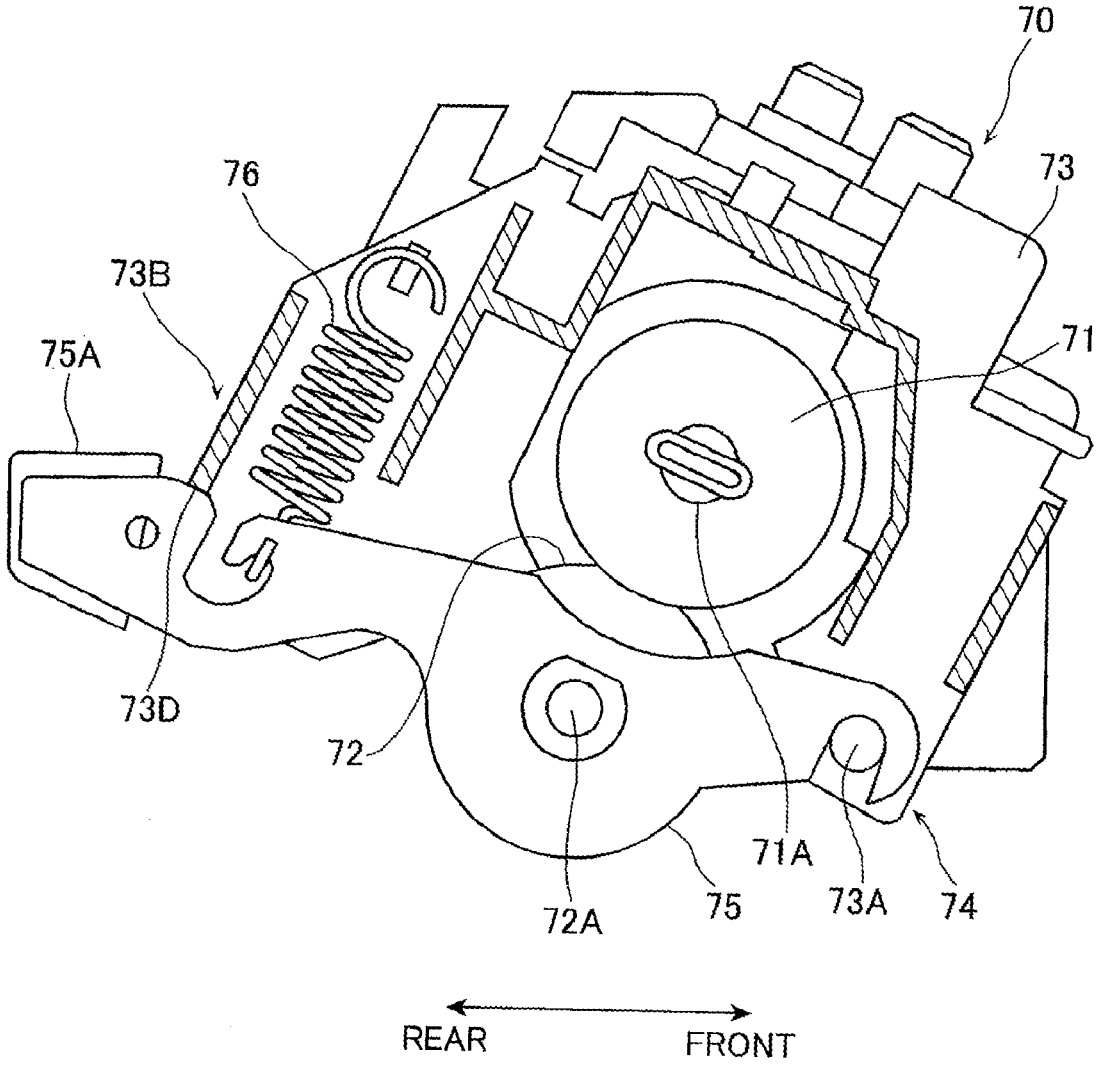
FIG. 4 is a side view of the fixing unit shown in FIG. 3.

The unit cover 73 is further provided with a stopper 73B and ribs 73C. The stopper 73B abuttingly stops the support lever 75 at a predetermined position against the restorative force of the spring 76. The ribs 73C are disposed near the heating roller 71. The stopper 73B and the ribs 73C are formed integrally with the unit cover 73. The stopper 73B can prevent the pressure roller 72 from pressing against the heating roller 71 with more force than necessary, thereby preventing the nip width between the heating roller 71 and pressure roller 72 from growing too large when a toner image is being fixed on the recording medium. FIG. 4 is a side view of the fixing unit 70 without the cover. As shown in FIG. 4, the support lever 75 contacts the stopper 73B and comes to a halt at a contact position 73D.

Since the pressure roller 72 is normally formed of an elastic material such as silicon rubber, it is necessary to reduce variations in the hardness of the pressure rollers for maintaining a suitable nip width, particularly when the pressure rollers are mass-produced. However, the stopper 73B provided in the present embodiment ensures that a suitable nip width is maintained even when the hardness of the pressure roller 72 decreases somewhat. As a result, pressure rollers can be used in the laser printer 1, even if the hardness of the pressure roller varies from an intended value, thereby increasing the yield rate of the pressure rollers in the manufacturing process and contributing to a reduction in the manufacturing costs of the image forming device.

(3) Detailed Construction of the Paper Discharge Unit

After passing through the fixing unit 70 as described above, the sheet of paper is conveyed to the paper discharge unit 80. Next, the construction of the paper discharge unit 80 will be described in greater detail. As shown in FIG. 2, in the laser printer 1 of the present embodiment, the fixing unit 70 is disposed below and adjacent to the sheet discharge tray 52. In this state, the fixing unit 70 cannot be replaced when the rear cover 60 is open because the sheet discharge tray 52 formed as a depressed portion in the top cover 18 interferes with the fixing unit 70 (more specifically, the tray member 54 interferes with the fixing unit 70). In other words, the tray member 54 overlaps the fixing unit 70 when viewed through the opening 2*e*.

Figure 5:
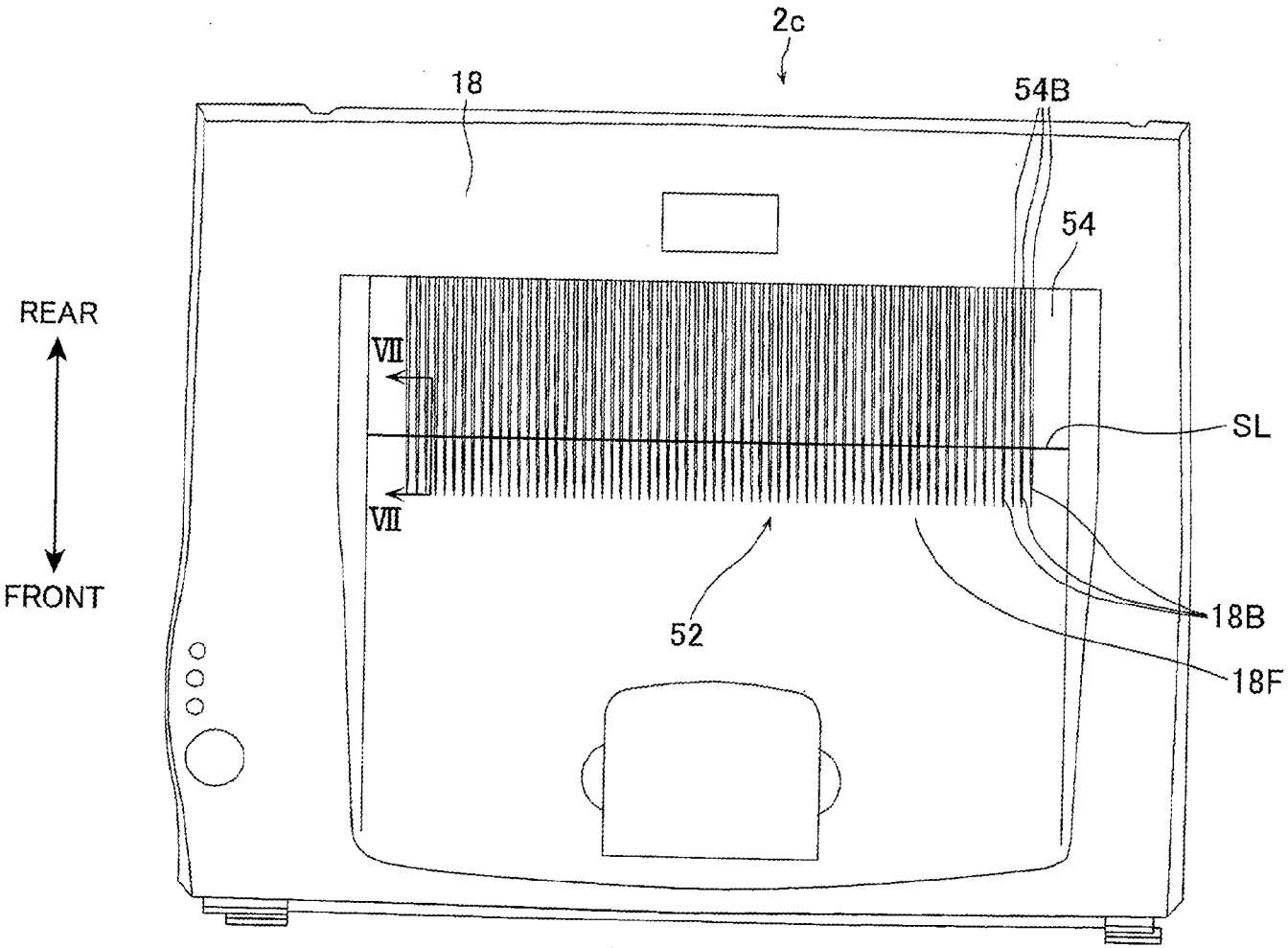
FIG. 5 is a top view of a top cover forming part of a casing of the laser printer.

Hence, in the present embodiment, a portion of the sheet discharge tray 52 on the rear side is configured of the detachable (removable) tray member 54. By detaching the tray member 54, sufficient space is secured for inserting and removing the fixing unit 70. FIG. 5 is a top view of the top cover 18, showing that the tray member 54 configures a portion of the sheet discharge tray 52 near the discharge opening (the portion of the sheet discharge tray 52 on the further rear side than a solid line SL in FIG. 5). A plurality of ribs 18B and 54B are disposed over the entire sheet discharge tray 52 in an orientation parallel to the paper conveying direction. In FIG. 5, the reference numeral 18B represents ribs provided on the fixed wall portion 18F of the top cover 18, while the reference numeral 54B represents ribs provided on the tray member 54. These ribs facilitate the smooth discharge of paper by reducing the frictional resistance applied to the paper.

Figure 6:
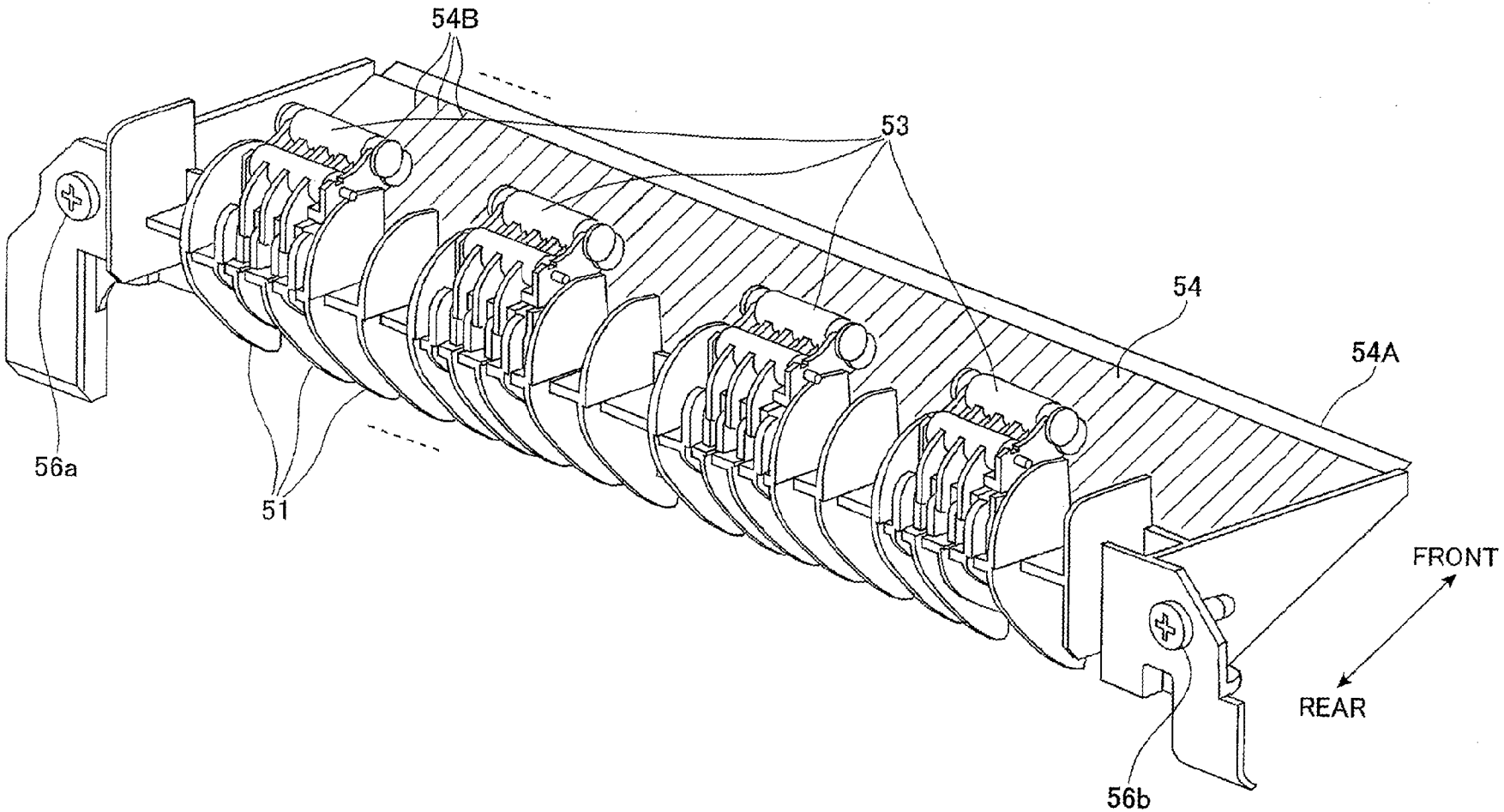
FIG. 6 is a perspective view showing the construction of a tray member disposed in the top cover.

FIG. 6 is a perspective view illustrating the construction of the tray member 54 according to the first embodiment. In the first embodiment, the tray member 54 that configures a portion of the sheet discharge tray 52 is integrally formed with the inner guide member 51 that forms a portion of the paper conveying path. A protrusion 54A is disposed on the front end of the tray member 54 (the downstream end in the paper conveying direction). FIG. 7 is an enlarged cross-sectional view taken along a line VII-VII in FIG. 5. As shown in FIGS. 2 and 7, a tray-member mounting opening 18*g* is formed in the top cover 18 for mounting the tray member 54. Note that FIGS. 2 and 7 show a state in which the tray member 54 is already fitted in the tray-member mounting opening 18*g*. As shown in FIG. 7, the tray member 54 is fitted into the tray-member mounting opening 18*g* such that an upper edge 54U of the tray member 54 on the downstream end in the paper conveying direction (i.e., upper edges of the ribs 54B on the downstream ends) is positioned higher than an upper edge 18U of the fixed wall portion 18F on the upstream end (i.e., upper edges of the ribs 18B on the upstream ends).

With this construction, a step 54S is formed at a bordering portion (contact portion) between the tray member 54 and the fixed wall portion 18F. This construction prevents the leading edge of a sheet of paper discharged through the discharge opening from catching on the contact portion, facilitating a smooth discharge of the paper. While the step 54S is easily visible in FIG. 7, the actual size of the step 54S need not be this large, as long as the paper is discharged smoothly.

When fitting the tray member 54 into the tray-member mounting opening 18*g*, a top surface 54T of the protrusion 54A slides beneath and contacts a bottom surface 18T of an end portion 18A of the fixed wall portion 18F. This construction can prevent steam that is generated while fixing an image on the paper from leaking through the bordering portion between the tray member 54 and the fixed wall portion 18F of the top cover 18 onto the sheet discharge tray 52.

The components disposed adjacent to the fixing unit 70, particularly the tray member 54, are preferably formed of a heat-resistant resin because the fixing unit 70 can produce temperatures of 100 degrees Celsius or greater. One example of a heat-resistant material is PC-ABS (a polycarbonate and ABS alloy), but the heat-resistant material is not limited to this material. For example, polybutylene teraphthalate and the like may also be used. By using the heat-resistant resin for only the particular components, it is possible to reduce the amount of heat-resistant resin being used, effectively reducing manufacturing costs.

While ribs 54B and 18B are provided on the sheet discharge tray 52 in the present embodiment, the similar effects can be achieved without ribs by setting the surface height of the fixed wall portion 18F lower than the surface of the tray member 54 at the contact portion between the tray member 54 and the fixed wall portion 18F.

Figure 8:
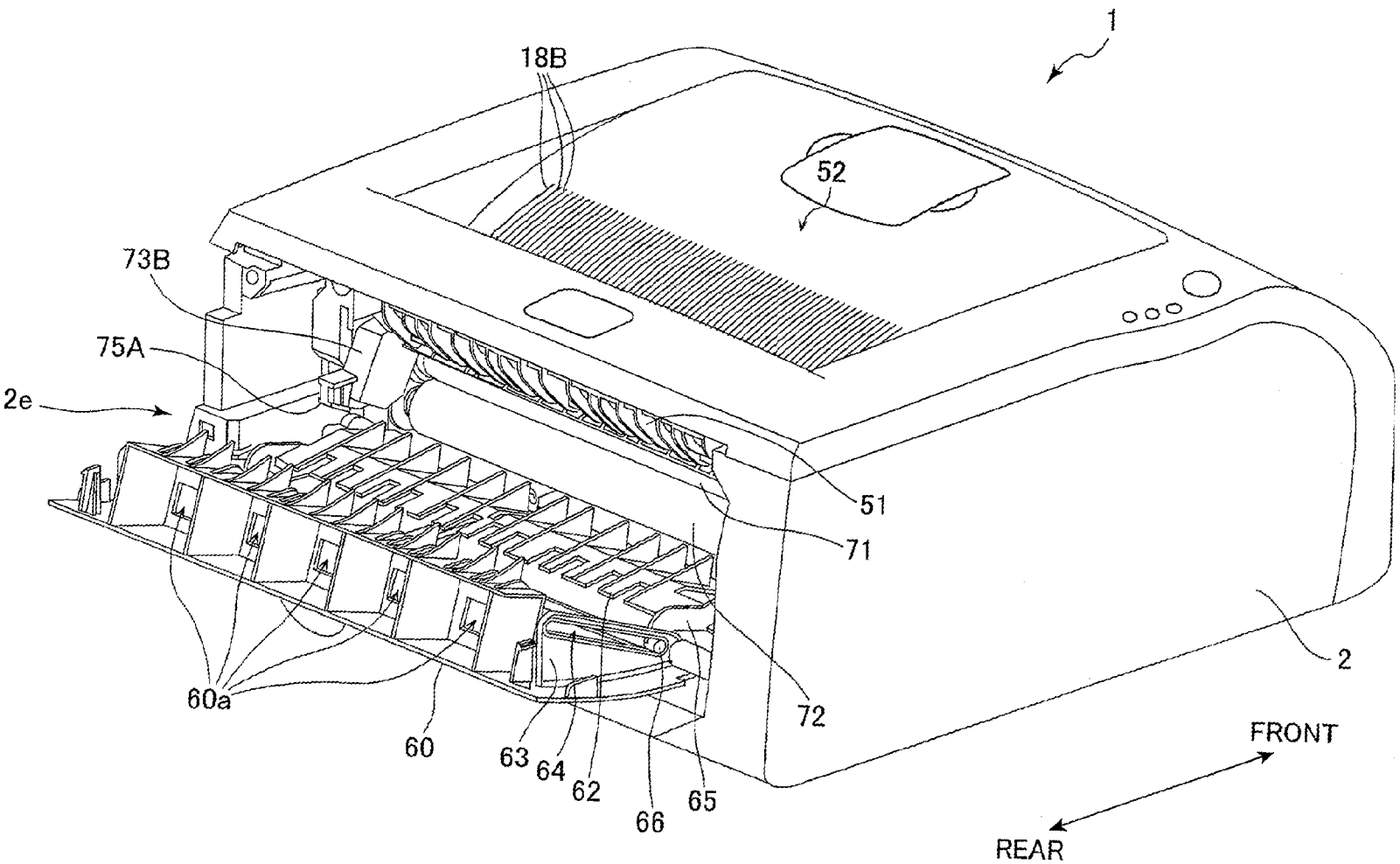
FIG. 8 is a perspective view showing an opening formed in a rear side wall of the casing when a rear cover is in an open state.

FIG. 8 is a perspective view showing the laser printer 1 from the rear side wall 2*c* side when the rear cover 60 is in an open state. As shown in FIG. 8, when the rear cover 60 is in an open state, the inner guide member 51 is exposed from outside the casing 2 through the opening 2*e*. Thus, the tray member 54 and the inner guide member 51 can be removed as a unit through the opening 2*e* formed in the rear side wall 2*c*. When the tray member 54 and the inner guide member 51 have been removed, the fixing unit 70 is exposed from outside the casing 2 through the opening 2*e* and thus the fixing unit 70 can be removed through the opening 2*e*. The heat dissipation openings 60*a* are formed through the rear cover 60 at five locations to prevent the fixing unit 70 from becoming too hot.

Next, the process for removing the tray member 54 and the fixing unit 70 will be described in detail.

As shown in FIG. 8, the user first opens the rear cover 60 in order to replace the fixing unit 70. In the present embodiment, the outer guide member 62 pivots rearward together with the rear cover 60 as the rear cover 60 is opened. More specifically, a plate-shaped guide member 63 is provided on the right end of the rear cover 60 in FIG. 8. The guide member 63 has an elongated hole 64 formed therein. A plate-shaped member 65 is provided on the right end of the outer guide member 62 and has a protrusion 66 formed thereon. The protrusion 66 slides along the elongated hole 64 while inserted therein. As the rear cover 60 is opened and the elongated hole 64 moves rearward, the protrusion 66 slides within the elongated hole 64, allowing the outer guide member 62 to pivot rearward gradually and create an opening for removing the fixing unit 70. As shown in FIG. 8, the user can reach in and press the grip 75A downward when the opening has been created, thereby facilitating the resolution of paper jams and the like in the fixing unit 70.

Figure 9:
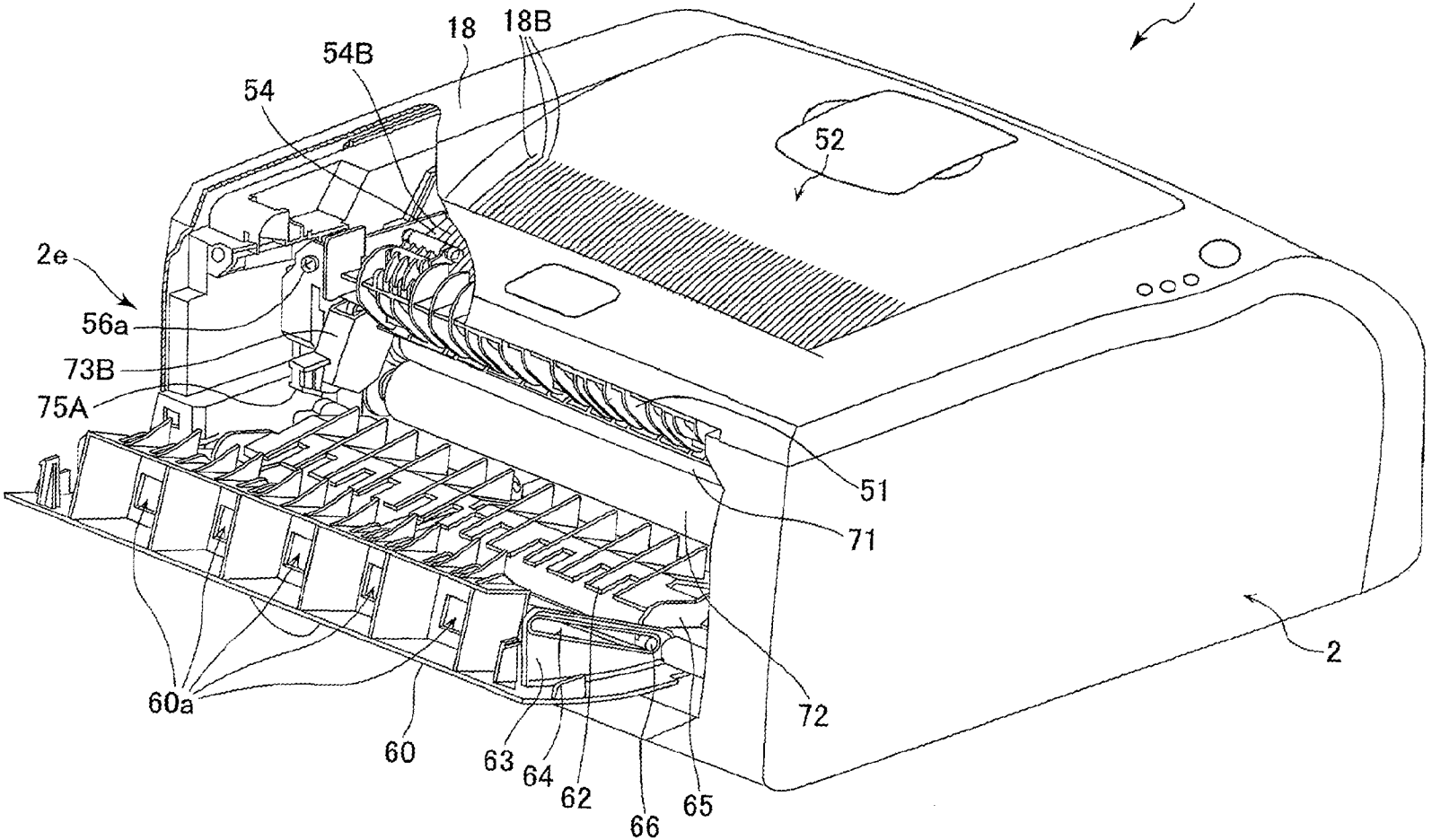
FIG. 9 is a perspective view with a portion of the top cover cut away, showing the tray member mounted inside the casing.

FIG. 9 is a perspective view showing the laser printer 1 with a portion of the top cover 18 cut away, while the rear cover 60 is in an open state. As shown in FIG. 9, the tray member 54 formed integrally with the inner guide member 51 is fastened to the inside of the casing 2 by screws 56*a* and 56*b* (see FIG. 6). By removing the screws 56*a* and 56*b*, the tray member 54 can be removed through the opening 2*e* formed by the open rear cover 60.

Figure 10:
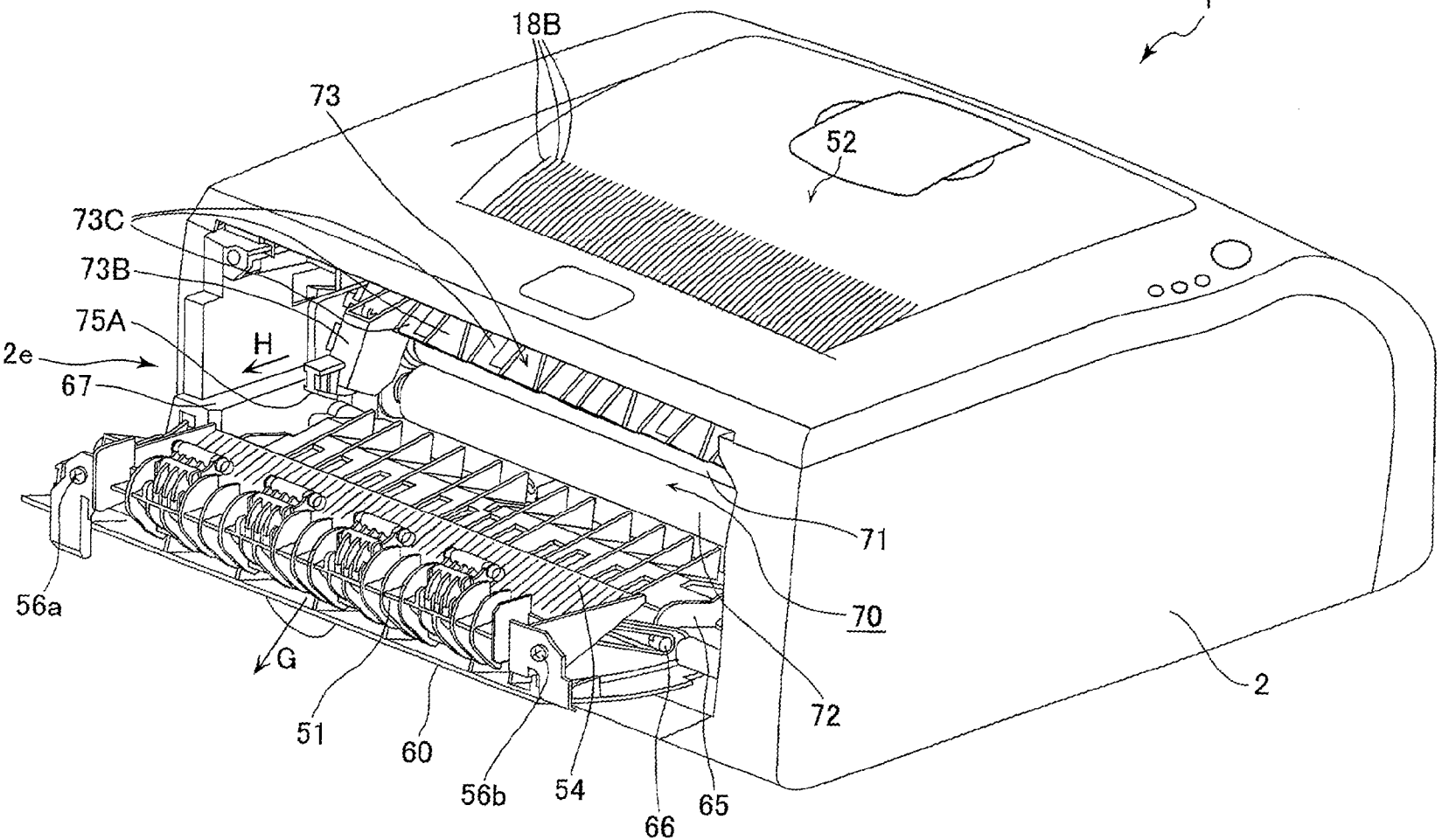
FIG. 10 is a perspective view illustrating the procedure for removing the fixing unit.

FIG. 10 is a perspective view showing the laser printer 1 when the tray member 54 has been removed. As shown in FIG. 10, the ribs 73C formed integrally with the unit cover 73 can be exposed by removing the inner guide member 51 and tray member 54 in the direction indicated by an arrow G, thereby forming a space through which the entire fixing unit 70 can pass. The user can remove the fixing unit 70 by sliding the fixing unit 70 over a step portion 67 in the direction indicated by an arrow H, thereby facilitating replacement of the fixing unit 70. Since the top surface 54T of the protrusion 54A of the tray member 54 is positioned underneath the bottom surface 18T of the fixed wall portion 18F as described earlier (FIG. 7), the protrusion 54A is not hindered by the top cover 18 when the tray member 54 and the like are removed through the opening 2*e* in the rear side wall 2*c*.

In the image forming device described above, the removable tray member 54 configures part of the depressed portion formed in the sheet discharge tray 52. Hence, space for inserting and removing the fixing unit 70 can be secured by removing the tray member 54, thereby allowing the fixing unit 70 to be disposed below and adjacent to the sheet discharge tray 52. As a result, the image forming device can be made more compact (in particular, the height can be reduced), while facilitating replacement of the fixing unit 70.

Second Embodiment

An image forming device and a fixing device according to a second embodiment of the present invention will be described while referring to FIGS. 11 through 13.

Figure 11:
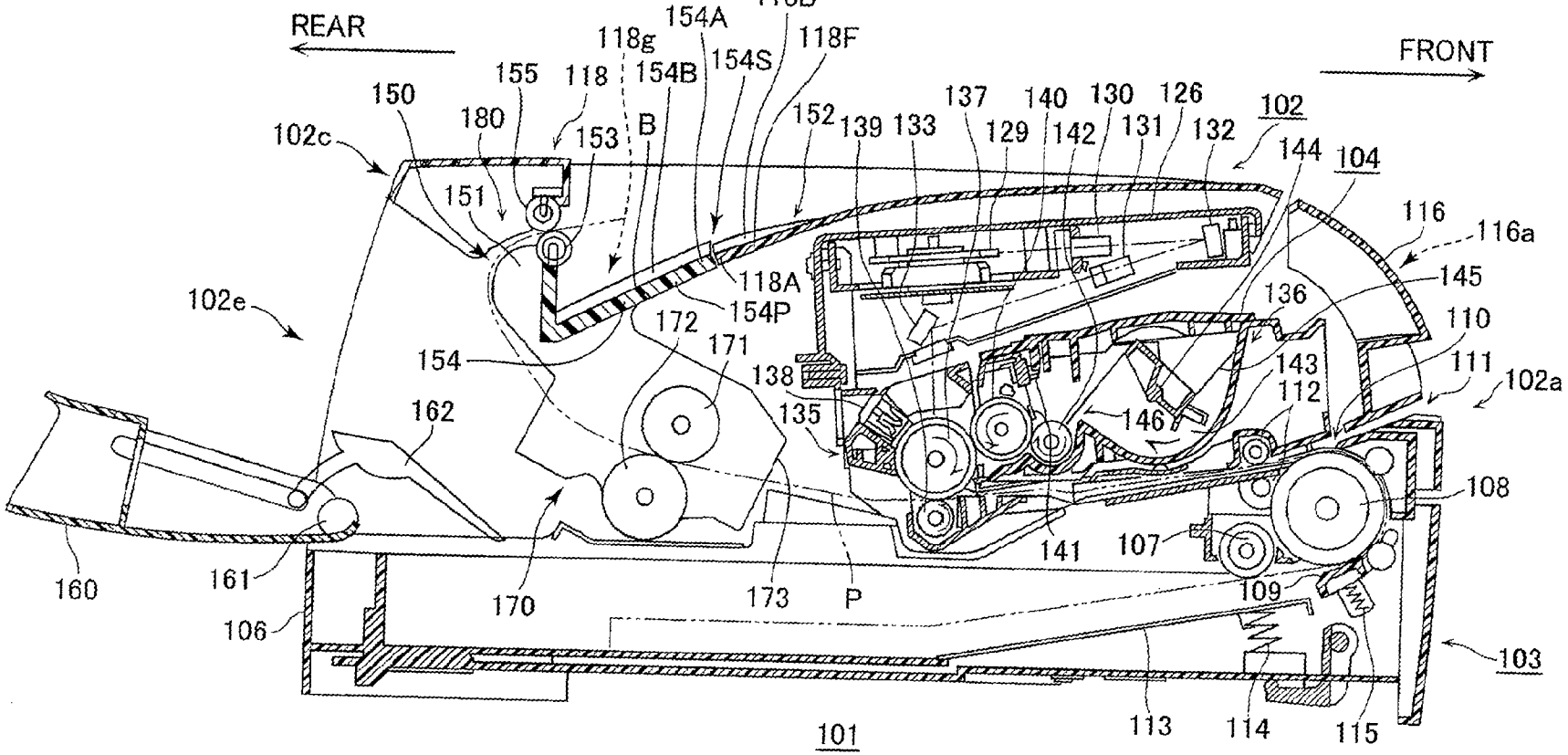
FIG. 11 is a vertical cross-sectional view showing a laser printer according to a second embodiment of the present invention.

FIG. 11 is a vertical cross-sectional view showing a laser printer 101 according to the second embodiment. As shown in FIG. 11, the laser printer 101 includes a casing 102 having a top cover 118 forming the top wall of the casing 102, and four side walls including front side wall 102*a* and rear side wall 102*c*. A portion of the top cover 118 is depressed (recessed) toward inside the casing 102 to form a sheet discharge tray 152. In the present embodiment, the side wall near a fixing unit 170 on the left side in FIG. 11 is the rear side wall 102*c*, while the side wall opposite the rear side wall 102*c* is the front side wall 102*a*. The front side wall 102*a* and the rear side wall 102*c* each extends in a direction substantially parallel to an axial direction of fixing rollers 171 and 172 described later.

The sheet discharge tray 152 is substantially rectangular in shape in a plan view. The rear end of the sheet discharge tray 152 is formed as a depressed portion that is depressed toward inside the casing 102 and slopes gradually upward toward the front side wall 102*a* side of the casing 102. In the present embodiment, a section of the sheet discharge tray 152 that slopes gradually upward from the rear end to a point in the middle of the sheet discharge tray 152 is configured by the tray member 154. A front end 154A of the tray member 154 (the downstream end in the paper conveying direction) contacts or is adjacent to a rear end (the upstream end) 118A of a fixed wall portion 118F of the top cover 118. The tray member 154 is formed integrally with a unit cover 173 described later serving as a frame for covering the fixing unit 170.

A paper supply cassette 106 is provided in the bottom section of the casing 102 and can be inserted into or removed from the casing 102 via the front side wall 102*a*. The paper supply cassette 106 can accommodate a plurality of sheets of a paper or other recording medium. The front side wall 102*a* also includes a front cover 116 that is swingably open or closed on the front of the casing 102, and a manual feed tray 111 disposed on the front cover 116 for hand-feeding a recording medium one sheet at a time. As mentioned earlier, the front cover 116 is provided on the front side wall 102*a* of the casing 102 and can be freely opened and closed on the casing 102. When the front cover 116 is in an open state, a front side opening 116*a* is revealed in the casing 102 through which a process cartridge 104 can be inserted or removed.

In FIG. 11, the fixing unit 170 and the tray member 154 have been simplified for illustration purposes. Also accommodated in the casing 102 are a paper feed unit 103 for supplying a paper or other recording medium (a conveying path along which the recording medium is conveyed is represented by a two-dot chain line P); the process cartridge 104 for forming visible toner images on the paper conveyed from the paper feed unit 103; the fixing unit 170 mentioned above for fixing the toner image to the paper; and a paper discharge unit 180 for discharging the paper after the paper has passed through the fixing unit 170.

The paper feed unit 103 includes the paper supply cassette 106; and feeding rollers 107 and 108, and a separating pad 109 disposed above the leading edge of the paper stacked in the paper supply cassette 106 with respect to the paper conveying direction (the front side of the laser printer 101). The paper supply cassette 106 is disposed below the process cartridge 104 and the fixing unit 170 and can be inserted into and removed from the casing 102 through the front side. The paper feed unit 103 turns the direction of the sheet supplied from the paper cassette 106 so that the sheet is conveyed below the process cartridge 104.

A sheet of paper supplied from the paper supply cassette 106 or the manual feed tray 111 is conveyed to registration rollers 112 disposed above the feeding roller 107. The registration rollers 112 first register the sheet and then convey the sheet to an image forming position beneath the process cartridge 104 (a contact position between a photosensitive drum 137 and a transfer roller 139 described later).

A scanning unit 126 is disposed above the process cartridge 104 for scanning the surface of a photosensitive drum 137 disposed in the process cartridge 104 in order to form an electrostatic latent image thereon.

The process cartridge 104 includes a drum cartridge 135 and a developing cartridge 136. The drum cartridge 135 accommodates the photosensitive drum 137, a charger 138, a transfer roller 139, and the like. The developer cartridge 136 is detachably mounted on the drum cartridge 135 and includes a developing roller 140, a thickness regulating blade 141, a supply roller 142, a toner hopper 143, and the like.

In the process cartridge 104, the toner image carried on the surface of the photosensitive drum 137 is transferred onto the paper due to the transfer bias applied to the transfer roller 139, as the sheet of paper passes between the photosensitive drum 137 and the transfer roller 139.

The fixing unit 170 is disposed above the paper supply cassette 106 and to the side and downstream of the process cartridge 104 with respect to the paper conveying direction. After a visible toner image is transferred onto a sheet of paper at the process cartridge 104, the toner image is fixed to the sheet in the fixing unit 170 by the heat of the heating roller 171 as the sheet passes between the heating roller 171 and the pressure roller 172. Subsequently, the heating roller 171 and pressure roller 172 convey the sheet onto a paper discharge path 150 formed in the paper discharge unit 180.

Figure 12:
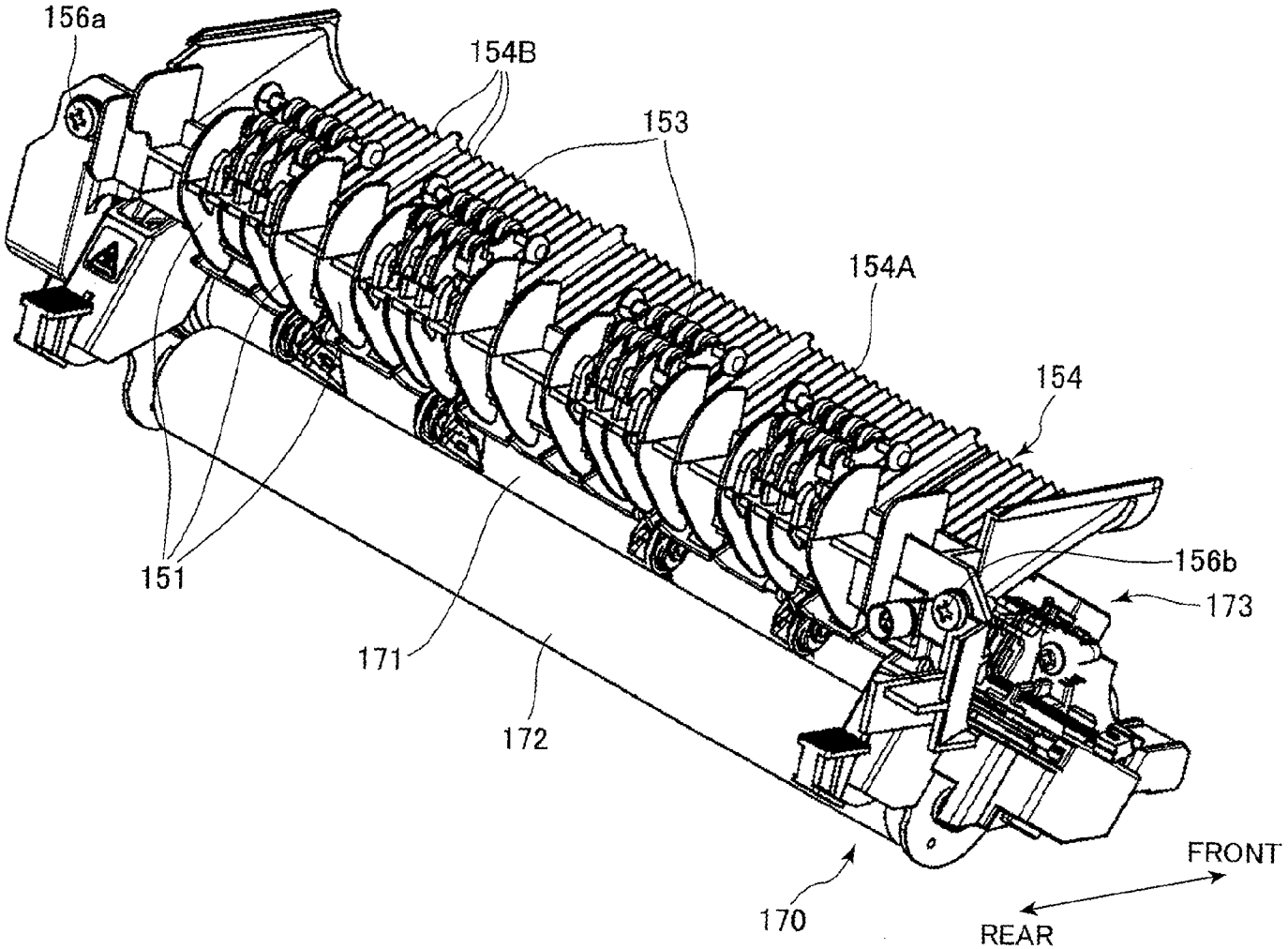
FIG. 12 is a perspective view illustrating the construction of a fixing unit and a tray member according to the second embodiment.

FIG. 12 is a perspective view illustrating the construction of the fixing unit 170 and the tray member 154. The fixing unit 170 according to the second embodiment includes the heating roller 171, and the pressure roller 172 disposed beneath the heating roller 171 and pressing against the surface of the same.

The unit cover 173 covers the upper portion of the heating roller 171 (an end of the unit cover 173 has been cut away in FIG. 12 for illustrative purposes). The unit cover 173 is formed (molded) of a resin, such as polyethylene teraphthalate (PET). As shown in FIG. 11, the unit cover 173 does not cover the entirety of the pressure roller 172 and, hence, part of the pressure roller 172 (a lower portion of the pressure roller 172) is exposed without being covered by the unit cover 173. In the present embodiment, the tray member 154 is formed integrally with the unit cover 173 at the region above the heating roller 171. That is, the tray member 154 is provided integrally with the fixing unit 170.

As shown in FIG. 11, the tray member 154 provided integrally with the fixing unit 170 is fitted in a tray-member mounting opening 118*g* formed in the top cover 118, thereby providing the depressed portion of the sheet discharge tray 152. A plurality of ribs 118B and 154B are disposed over the entire sheet discharge tray 152 in an orientation parallel to the paper conveying direction. In FIG. 11, the reference numeral 118B represents ribs provided on the fixed wall portion 118F of the top cover 118, while the reference numeral 154B represents ribs provided on the tray member 154. These ribs facilitate the smooth discharge of paper by reducing the frictional resistance applied to the paper.

An inner guide member 151 is provided on the rear side of the tray member 154. The inner guide member 151 forms part of the paper conveying path P. Lower discharge rollers 153 and upper discharge rollers 155 are arranged in the left-right direction (FIG. 12) and are disposed above the inner guide member 151. Like the first embodiment, the tray member 154 is fitted into the tray-member mounting opening 118*g* such that an upper edge of the tray member 154 on the downstream end in the paper conveying direction (i.e., upper edges of the ribs 154B on the downstream ends) is positioned higher than an upper edge of the fixed wall portion 118F on the upstream end (i.e., upper edges of the ribs 118B on the upstream ends).

With this construction, a step 154S is formed at a bordering portion (contact portion) between the tray member 154 and the fixed wall portion 118F. This construction prevents the leading edge of a sheet of paper discharged through the discharge hole from catching on the bordering portion, facilitating a smooth discharge of the paper. While the step 154S is visible in FIG. 11, the actual size of the step 154S need not be this large, as long as the paper is discharged smoothly.

As shown in FIG. 12, the tray member 154 is fastened to the casing 102 by screws 156*a* and 156*b*. In this way, the fixing unit 170 that is integrally provided with the tray member 154 is securely fixed to the casing 102. Accordingly, positional deviations of the fixing unit 170 and the like are unlikely to occur when the laser printer 101 is operating.

The components disposed adjacent to the fixing unit 170, particularly the tray member 154 and the unit cover 173, are preferably formed of a heat-resistant resin because the fixing unit 170 can produce temperatures of 100 degrees Celsius or greater. One example of a heat-resistant material is PC-ABS (a polycarbonate and ABS alloy), but the heat-resistant material is not limited to this material. For example, polybutylene teraphthalate and the like may also be used. After passing through the fixing unit 170, the paper is conveyed toward the paper discharge unit 180.

The paper discharge unit 180 includes an inner guide member 151 described above and an outer guide member 162 that form the paper discharge path 150; the lower discharge rollers 153 and upper discharge rollers 155 forming pairs of discharge rollers disposed in a discharge opening through which the paper is discharged onto the sheet discharge tray 152 provided on the top cover 118; and the tray member 154 constituting part of the sheet discharge tray 152. The outer guide member 162 moves in association with the opening and the closing of the rear cover 160 provided on the rear side wall 102*c* of the casing 102. The rear cover 160 is attached to the casing 102 via a hinge 161 and is capable of swinging open and closed about the hinge 161. When the rear cover 160 is swung to an open position, the top portion of the outer guide member 162 pivots rearward in association. In this way, the paper discharge path 150 can be exposed through an opening 102*e* formed in the rear side wall 102*c* by opening the rear cover 160.

After passing through the paper discharge unit 180, the sheet of paper is discharged into the sheet discharge tray 152, thus completing the printing operation. As shown in FIG. 13, when the rear cover 160 is in an open state, the tray member 154 and the fixing unit 170 can be removed as a unit through the opening 102*e* formed in the rear side wall 102*c*. The procedure for removing the tray member 154 and fixing unit 170 will be described below in detail.

Figure 13:
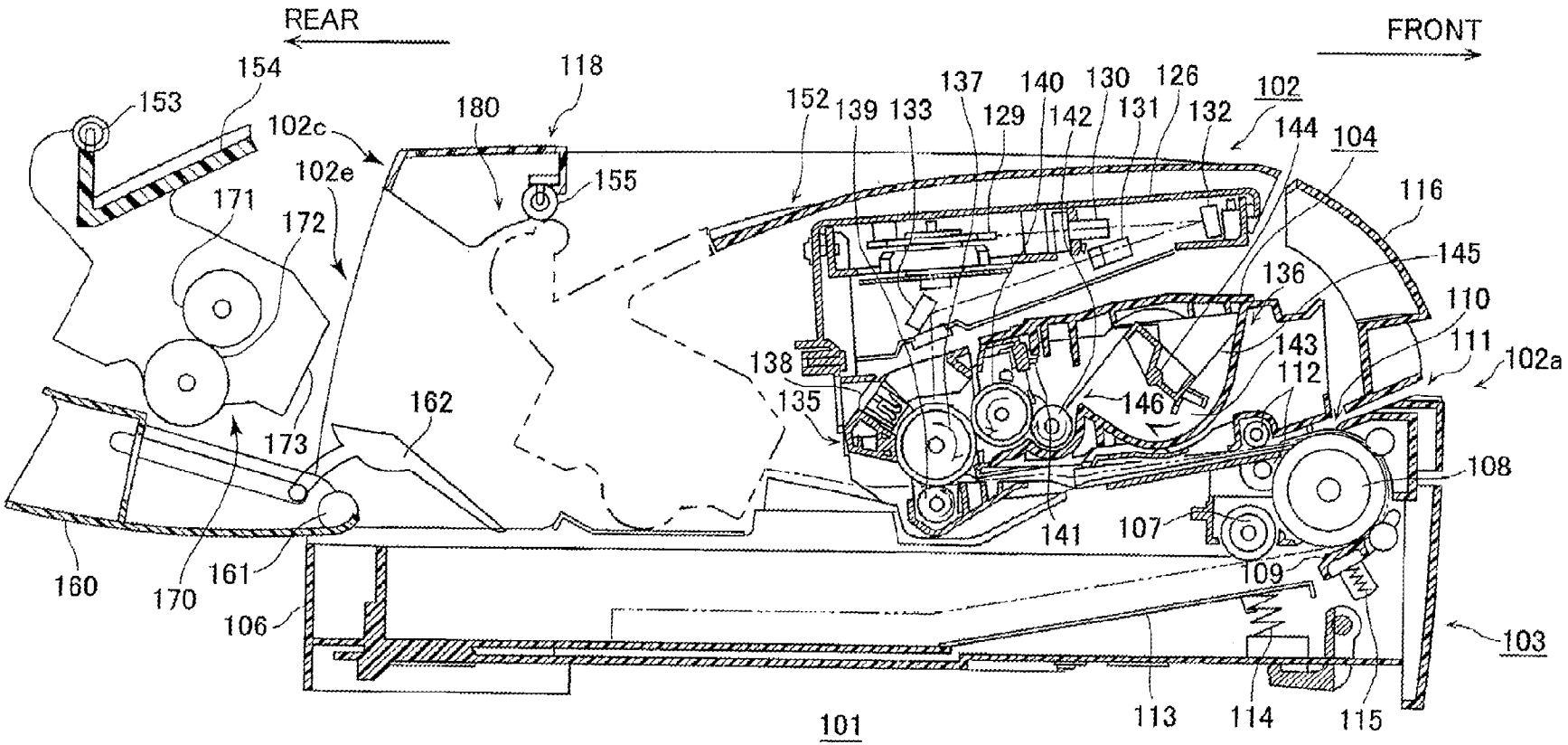
FIG. 13 is a vertical cross-sectional view showing the laser printer according to the second embodiment when the fixing unit and the tray member have been removed.

As shown in FIG. 13, the user first opens the rear cover 160 in order to remove the fixing unit 170. The outer guide member 162 pivots rearward together with the rear cover 160 as the rear cover 160 is opened. This operation creates sufficient space for removing the entire tray member 154 and fixing unit 170 assembly (combined unit) through the opening 102*e*. As described above, the tray member 154 is fastened inside the casing 102 by the screws 156*a* and 156*b* (FIG. 12). Hence, by removing the screws 156*a* and 156*b*, the tray member 154 and fixing unit 170 can be removed through the opening 102*e* formed when the rear cover 160 is opened.

After the screws 156*a* and 156*b* have been removed from the tray member 154, the combined unit of the tray member 154 and fixing unit 170 is rotated slightly counterclockwise in FIG. 11 so as to disengage the combined unit from the mount position. Subsequently, the combined unit is pulled through the opening 102*e* while rotating the combined unit clockwise or counterclockwise as needed until the combined unit is removed entirely from the casing 102.

Further, the combined unit of the tray member 154 and the fixing unit 170 is easily mounted by performing the procedure described above in reverse.

In the laser printer 101 of the second embodiment described above, the tray member 154 and fixing unit 170 can be mounted as a unit and can be removed from the casing 102 as a unit so that components are not left scattered about, thereby facilitating a replacement operation of the fixing unit. Further, the fixing unit 170 can be disposed below and adjacent to the sheet discharge tray 152, allowing the device to be made more compact (in particular, the height can be reduced).

Third Embodiment

An image forming device and a fixing device according to a third embodiment of the present invention will be described while referring to FIGS. 14 through 16.

Figure 14:
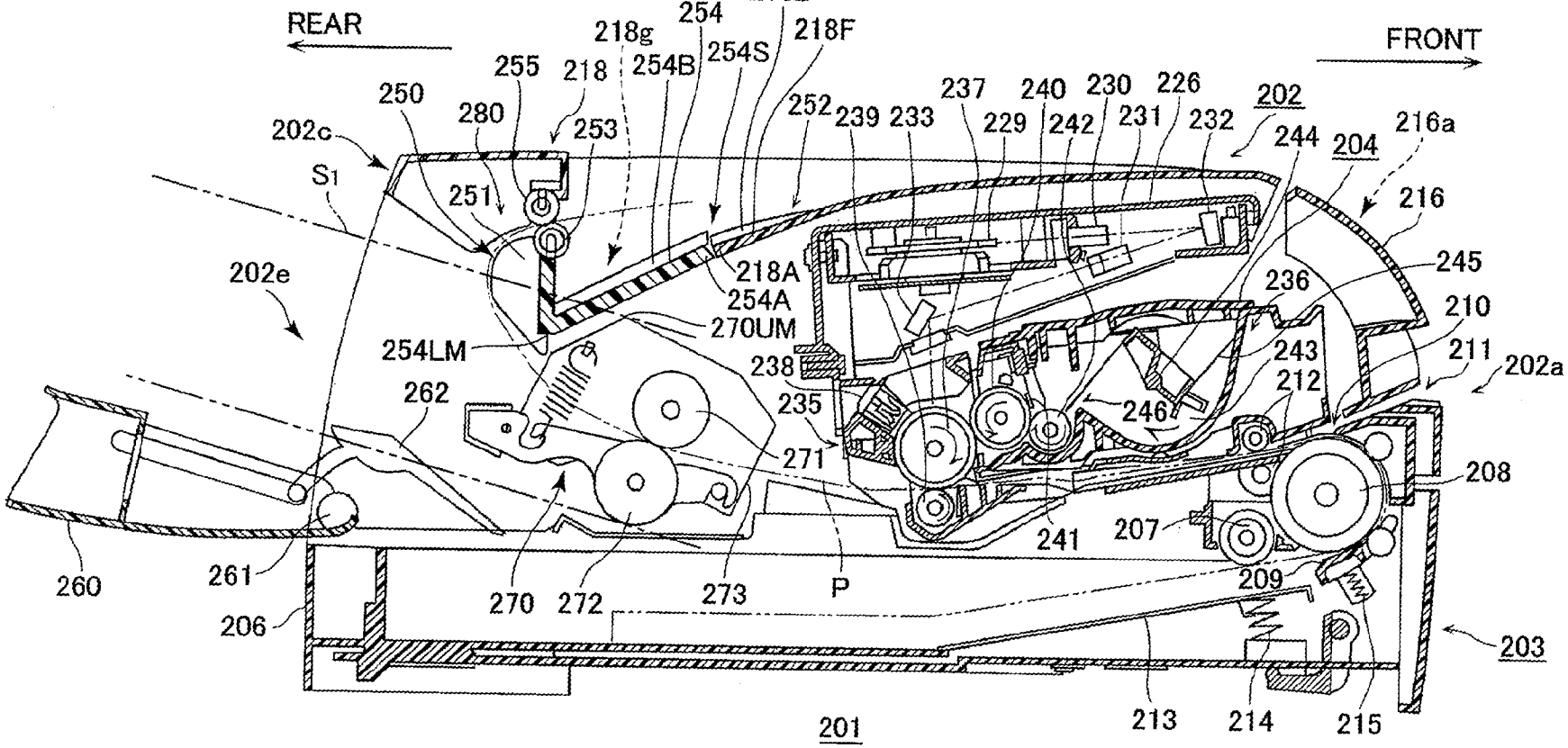
FIG. 14 is a vertical cross-sectional view showing a laser printer according to a third embodiment of the present invention.

FIG. 14 is a vertical cross-sectional view showing a laser printer 201 according to the third embodiment. As shown in FIG. 14, the laser printer 201 includes a casing 202 having a top cover 218 forming the top wall of the casing 202, and four side walls including front side wall 202*a* and rear side wall 202*c*. A portion of the top cover 218 is depressed (recessed) toward inside the casing 202 to form a sheet discharge tray 252. In the present embodiment, the side wall near a fixing unit 270 on the left side in FIG. 14 is the rear side wall 202*c*, while the side wall opposite the rear side wall 202*c* is the front side wall 202*a*. The front side wall 202*a* and the rear side wall 202*c* each extends in a direction substantially parallel to an axial direction of fixing rollers 271 and 272 described later.

The sheet discharge tray 252 is substantially rectangular in shape in a plan view. The rear end of the sheet discharge tray 252 is formed as a depressed portion that is depressed toward inside the casing 202 and slopes gradually upward toward the front side wall 202*a* side of the casing 202. In the present embodiment, a section of the sheet discharge tray 252 that slopes gradually upward from the rear end to a point in the middle of the sheet discharge tray 252 is configured by the tray member 254. A front end 254A of the tray member 254 (the downstream end in the paper conveying direction) contacts or is adjacent to a rear end (the upstream end) 218A of a fixed wall portion 218F of the top cover 218.

A paper supply cassette 206 is provided in the bottom section of the casing 202 and can be inserted into or removed from the casing 202 via the front side wall 202*a*. The paper supply cassette 206 can accommodate a plurality of sheets of a paper or other recording medium. The front side wall 202*a* also includes a front cover 216 that is swingably open or closed on the front of the casing 202, and a manual feed tray 211 disposed on the front cover 216 for hand-feeding a recording medium one sheet at a time. As mentioned earlier, the front cover 216 is provided on the front side wall 202*a* of the casing 202 and can be freely opened and closed on the casing 202. When the front cover 216 is in an open state, a front side opening 216*a* is revealed in the casing 202 through which a process cartridge 204 can be inserted or removed.

In FIG. 14, the fixing unit 270 and the tray member 254 have been simplified for illustration purposes. Also accommodated in the casing 202 are a paper feed unit 203 for supplying a paper or other recording medium (a conveying path along which the recording medium is conveyed is represented by a two-dot chain line P); the process cartridge 204 for forming visible toner images on the paper conveyed from the paper feed unit 203; the fixing unit 270 mentioned above for fixing the toner image to the paper; and a paper discharge unit 280 for discharging the paper after the paper has passed through the fixing unit 270.

Figure 15:
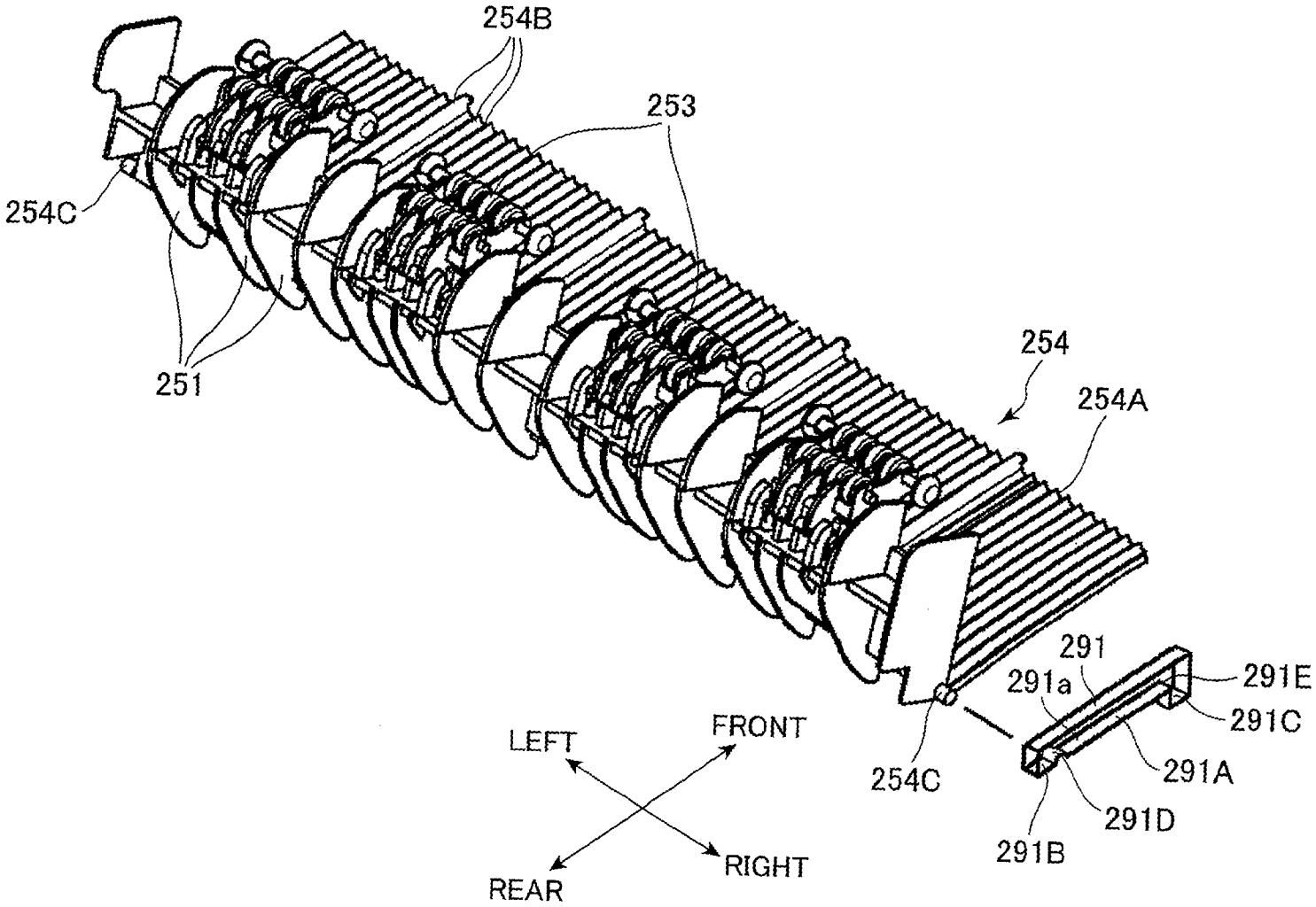
FIG. 15 is a perspective view illustrating the construction of a tray member according to the third embodiment.
Figure 16:
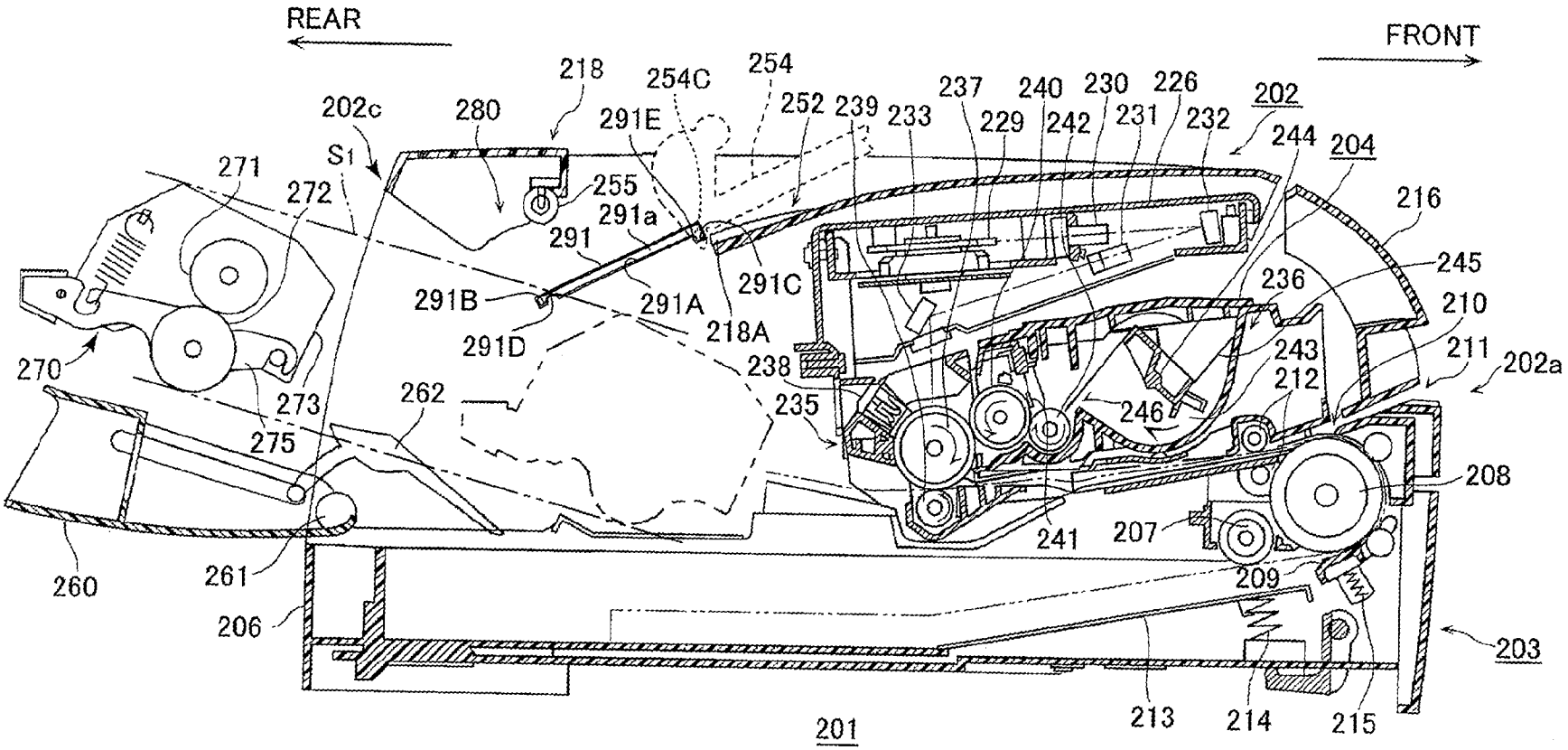
FIG. 16 is a vertical cross-sectional view showing the laser printer according to the third embodiment when a fixing unit has been removed.

As shown in FIGS. 15 and 16, groove portions 291 are formed on each of the right and left side walls of the casing 202. The groove portion 291 on the right side wall is shown in FIG. 15, and the groove portion 291 on the left side wall is shown in FIG. 16. Since the right-side and left-side groove portions 291 have symmetrical shapes, descriptions will be made for either one of the groove portions 291 below.

As shown in FIGS. 15 and 16, the groove portion 291 defines an engaging groove 291*a* for supporting the tray member 254 described later. The groove portion 291 is formed such that the engaging groove 291*a* slants upward from the rear side toward the front. An engaging protruding portion 254C provided at the tray member 254 described later is inserted in and slides along the engaging groove 291*a*. Accordingly, a support surface 291A is provided on a bottom wall configuring the groove portion 291 for supporting the engaging protruding portion 254C. A protruding portion 291D is formed on the support surface 291A. The protruding portion 291D has a substantially semicircular shape in cross section. A groove end portion 291B is formed at the rear end of the engaging groove 291*a*. The protruding portion 291D serves as a step portion between the support surface 291A and the groove end portion 291B. A depressed portion 291C is formed at the front end of the engaging groove 291*a* to be depressed downward. A vertical surface 291E is provided between the support surface 291A and the depressed portion 291C. The vertical surface 291E serves as another step portion. Accordingly, the two step portions are provided at positions spaced away from each other in a sliding direction in which the engaging protruding portion 254C slides.

The paper feed unit 203 includes the paper supply cassette 206; and feeding rollers 207 and 208, and a separating pad 209 disposed above the leading edge of the paper stacked in the paper supply cassette 206 with respect to the paper conveying direction (the front side of the laser printer 201). The paper supply cassette 206 is disposed below the process cartridge 204 and the fixing unit 270 and can be inserted into and removed from the casing 202 through the front side. The paper feed unit 203 turns the direction of the sheet supplied from the paper cassette 206 so that the sheet is conveyed below the process cartridge 204.

A sheet of paper supplied from the paper supply cassette 206 or the manual feed tray 211 is conveyed to registration rollers 212 disposed above the feeding roller 207. The registration rollers 212 first register the sheet and then convey the sheet to an image forming position beneath the process cartridge 204 (a contact position between a photosensitive drum 237 and a transfer roller 239 described later).

A scanning unit 226 is disposed above the process cartridge 204 for scanning the surface of a photosensitive drum 237 disposed in the process cartridge 204 in order to form an electrostatic latent image thereon.

The process cartridge 204 includes a drum cartridge 235 and a developing cartridge 236. The drum cartridge 235 accommodates the photosensitive drum 237, a charger 238, a transfer roller 239, and the like. The developer cartridge 236 is detachably mounted on the drum cartridge 235 and includes a developing roller 240, a thickness regulating blade 241, a supply roller 242, a toner hopper 243, and the like.

In the process cartridge 204, the toner image carried on the surface of the photosensitive drum 237 is transferred onto the paper due to the transfer bias applied to the transfer roller 239, as the sheet of paper passes between the photosensitive drum 237 and the transfer roller 239.

The fixing unit 270 is disposed above the paper supply cassette 206 and to the side and downstream of the process cartridge 204 with respect to the paper conveying direction. After a visible toner image is transferred onto a sheet of paper at the process cartridge 204, the toner image is fixed to the sheet in the fixing unit 270 by the heat of the heating roller 271 as the sheet passes between the heating roller 271 and the pressure roller 272. Subsequently, the heating roller 271 and pressure roller 272 convey the sheet onto a paper discharge path 250 formed in the paper discharge unit 280.

The fixing unit 270 according to the third embodiment includes the heating roller 271, and the pressure roller 272 disposed beneath the heating roller 271 and pressing against the surface of the same.

The unit cover 273 covers the upper portion of the heating roller 271. The unit cover 273 is formed (molded) of a resin, such as polyethylene teraphthalate (PET). As shown in FIG. 14, the unit cover 273 does not cover the entirety of the pressure roller 272 and, hence, part of the pressure roller 272 (a lower portion of the pressure roller 272) is exposed without being covered by the unit cover 273. In the present embodiment, the tray member 254 is disposed at the region above the heating roller 271.

As shown in FIG. 14, the tray member 254 is fitted in a tray-member mounting opening 218*g* formed in the top cover 218, thereby providing the depressed portion of the sheet discharge tray 252. In this state, part of the tray member 254 (the lowermost portion of the tray member 254) is positioned within a passage S1 through which the fixing unit 270 passes when inserted into or removed from the casing 202 and, hence, prevents the fixing unit 270 from being removed (this position is defined as a first position). More specifically, a lowermost portion 254LM of the tray member 254 is positioned lower than an uppermost portion 270UM of the fixing unit 270. Also, the lowermost portion 254LM of the tray member 254 is positioned closer to the rear side wall 202*c* than the uppermost portion 270UM of the fixing unit 270 is.

A plurality of ribs 218B and 254B are disposed over the entire sheet discharge tray 252 in an orientation parallel to the paper conveying direction. In FIG. 14, the reference numeral 218B represents ribs provided on the fixed wall portion 218F of the top cover 218, while the reference numeral 254B represents ribs provided on the tray member 254. These ribs facilitate the smooth discharge of paper by reducing the frictional resistance applied to the paper.

An inner guide member 251 is provided on the rear side of the tray member 254. The inner guide member 251 forms part of the paper conveying path P. Lower discharge rollers 253 and upper discharge rollers 255 are arranged in the left-right direction (FIG. 15) and are disposed above the inner guide member 251. Like the first embodiment, the tray member 254 is fitted into the tray-member mounting opening 218*g* such that an upper edge of the tray member 254 on the downstream end in the paper conveying direction (i.e., upper edges of the ribs 254B on the downstream ends) is positioned higher than an upper edge of the fixed wall portion 218F on the upstream end (i.e., upper edges of the ribs 218B on the upstream ends).

With this construction, a step 254S is formed at a contact portion between the tray member 254 and the fixed wall portion 218F. This construction prevents the leading edge of a sheet of paper discharged through the discharge hole from catching on the contact portion, facilitating a smooth discharge of the paper. While the step 254S is visible in FIG. 14, the actual size of the step 254S need not be this large, as long as the paper is discharged smoothly.

As shown in FIG. 15, the engaging protruding portions 254C are provided at the longitudinal ends and at the bottom ends of the tray member 254, protruding toward the side walls of the casing 202. Each engaging protruding portion 254C is fitted in the engaging groove 291*a*. Hence, the engaging protruding portions 254C can slide within the engaging grooves 291*a* while the tray member 254 is engaged with (or, slidably supported by) the casing 202 via the engaging protruding portions 254C. The engaging protruding portion 254C is positioned in the rearmost position of the engaging groove 291*a* when the tray member 254 is fitted in the tray-member mounting opening 218*g*. The protruding portion 291D (step portion) restricts the engaging protruding portion 254C positioned on the rear end of the engaging groove 291*a* from sliding in the engaging groove 291*a* toward the front. Hence, the protruding portion 291D prevents the tray member 254 from sliding unexpectedly.

The components disposed adjacent to the fixing unit 270, particularly the tray member 254 and the unit cover 273, are preferably formed of a heat-resistant resin because the fixing unit 270 can produce temperatures of 100 degrees Celsius or greater. One example of a heat-resistant material is PC-ABS (a polycarbonate and ABS alloy), but the heat-resistant material is not limited to this material. For example, polybutylene teraphthalate and the like may also be used. After passing through the fixing unit 270, the paper is conveyed toward the paper discharge unit 280.

The paper discharge unit 280 includes an inner guide member 251 described above and an outer guide member 262 that form the paper discharge path 250; the lower discharge rollers 253 and upper discharge roller 255 forming pairs of discharge rollers disposed in a discharge opening through which the paper is discharged onto the sheet discharge tray 252 provided on the top cover 218; and the tray member 254 constituting part of the sheet discharge tray 252. The outer guide member 262 moves in association with the opening and the closing of the rear cover 260 provided on the rear side wall 202*c* of the casing 202. The rear cover 260 is attached to the casing 202 via a hinge 261 and is capable of swinging open and closed about the hinge 261. When the rear cover 260 is swung to an open position, the top portion of the outer guide member 262 pivots rearward in association. In this way, the paper discharge path 250 can be exposed through an opening 202*e* formed in the rear side wall 202*c* by opening the rear cover 260.

After passing through the paper discharge unit 280, the sheet of paper is discharged into the sheet discharge tray 252, thus completing the printing operation. As shown in FIG. 16, when the rear cover 260 is in an open state, the fixing unit 270 can be removed through the opening 202*e* formed in the rear side wall 202*c*. The procedure for removing the fixing unit 270 will be described below in detail.

As shown in FIG. 16, the user first opens the rear cover 260 in order to remove the fixing unit 270. The outer guide member 262 pivots rearward together with the rear cover 260 as the rear cover 260 is opened. This operation creates the opening 202*e* through which the fixing unit 270 is removed.

However, when the tray member 254 is disposed in the first position, the lowermost portion of the tray member 254 is positioned within the passage S1 through which the fixing unit 270 passes when inserted into or removed from the casing 202 and, hence, prevents the fixing unit 270 from being removed. Accordingly, the tray member 254 is slidingly moved to a position outside the passage S1. This position is defined as a second position.

In order to move the tray member 254 from the first position to the second position, the tray member 254 is lifted slightly so that the engaging protruding portion 254C clears the protruding portion 291D, and the tray member 254 is slid along the engaging groove 291*a* so that the engaging protruding portion 254C slides along the support surface 291A. By sliding the engaging protruding portion 254C on the support surface 291A, ultimately the engaging protruding portion 254C drops into the depressed portion 291C, at which time the tray member 254 completes its movement to the second position outside of the passage S1.

Next, the fixing unit 270 is pulled through the passage S1 until completely removed from the casing 202.

After the tray member 254 has been moved to the second position, the engaging protruding portion 254C is engaged in the depressed portion 291C. Hence, the engaging protruding portion 254C cannot move onto the support surface 291A unless the engaging protruding portion 254C clears the vertical surface 291E (step portion). Accordingly, this construction prevents the tray member 254 from returning to the first position and blocking removal of the fixing unit 270.

Further, the fixing unit 270 and the tray member 254 are easily returned to their original positions (mount positions) by performing the procedure described above in reverse.

In the laser printer 201 according to the third embodiment described above, the fixing unit 270 can be removed while the tray member 254 is engaged in (or, supported by) the casing 202. Hence, it is not necessary to remove the tray member 254 in order to remove the fixing unit 270, thereby preventing loss of the tray member 254 that might occur when the tray member 254 is detached. Further, the fixing unit 270 can be disposed below and adjacent to the sheet discharge tray 252, enabling the device to be made more compact (in particular, the height can be reduced).

Fourth Embodiment

An image forming device and a fixing device according to a fourth embodiment of the present invention will be described while referring to FIGS. 17A through 19.

Figure 17A:
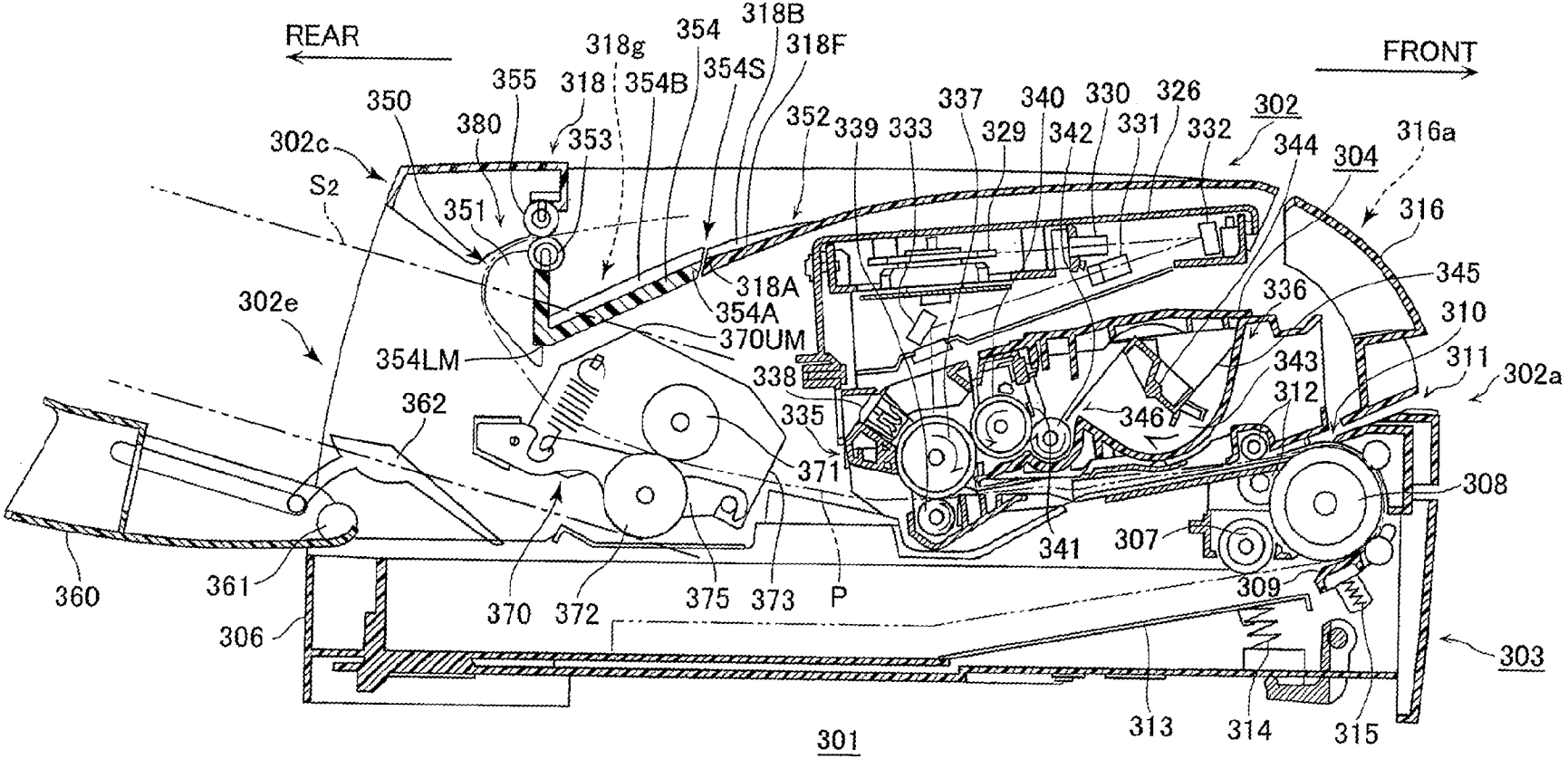
FIG. 17A is a vertical cross-sectional view showing a laser printer according to a fourth embodiment of the present invention.

FIG. 17A is a vertical cross-sectional view showing a laser printer 301 according to the fourth embodiment. As shown in FIG. 17A, the laser printer 301 includes a casing 302 having a top cover 318 forming the top wall of the casing 302, and four side walls including front side wall 302*a* and rear side wall 302*c*. A portion of the top cover 318 is depressed (recessed) toward inside the casing 302 to form a sheet discharge tray 352. In the present embodiment, the side wall near a fixing unit 370 on the left side in FIG. 17A is the rear side wall 302*c*, while the side wall opposite the rear side wall 302*c* is the front side wall 302*a*. The front side wall 302*a* and the rear side wall 302*c* each extends in a direction substantially parallel to an axial direction of fixing rollers 371 and 372 described later.

The sheet discharge tray 352 is substantially rectangular in shape in a plan view. The rear end of the sheet discharge tray 352 is formed as a depressed portion that is depressed toward inside the casing 302 and slopes gradually upward toward the front side wall 302*a* side of the casing 302. In the present embodiment, a section of the sheet discharge tray 352 that slopes gradually upward from the rear end to a point in the middle of the sheet discharge tray 352 is configured by a tray member 354. A front end 354A of the tray member 354 (the downstream end in the paper conveying direction) contacts or is adjacent to a rear end (the upstream end) 318A of a fixed wall portion 318F of the top cover 318.

A paper supply cassette 306 is provided in the bottom section of the casing 302 and can be inserted into or removed from the casing 302 via the front side wall 302*a*. The paper supply cassette 306 can accommodate a plurality of sheets of a paper or other recording medium. The front side wall 302*a* also includes a front cover 316 that is swingably open or closed on the front of the casing 302, and a manual feed tray 311 disposed on the front cover 316 for hand-feeding a recording medium one sheet at a time. As mentioned earlier, the front cover 316 is provided on the front side wall 302*a* of the casing 302 and can be freely opened and closed on the casing 302. When the front cover 316 is in an open state, a front side opening 316*a* is revealed in the casing 302 through which a process cartridge 304 can be inserted or removed.

In FIG. 17A, the fixing unit 370 and the tray member 354 have been simplified for illustration purposes. Also accommodated in the casing 302 are a paper feed unit 303 for supplying a paper or other recording medium (a conveying path along which the recording medium is conveyed is represented by a two-dot chain line P); the process cartridge 304 for forming visible toner images on the paper conveyed from the paper feed unit 303; the fixing unit 370 mentioned above for fixing the toner image to the paper; and a paper discharge unit 380 for discharging the paper after the paper has passed through the fixing unit 370.

Figure 17B:
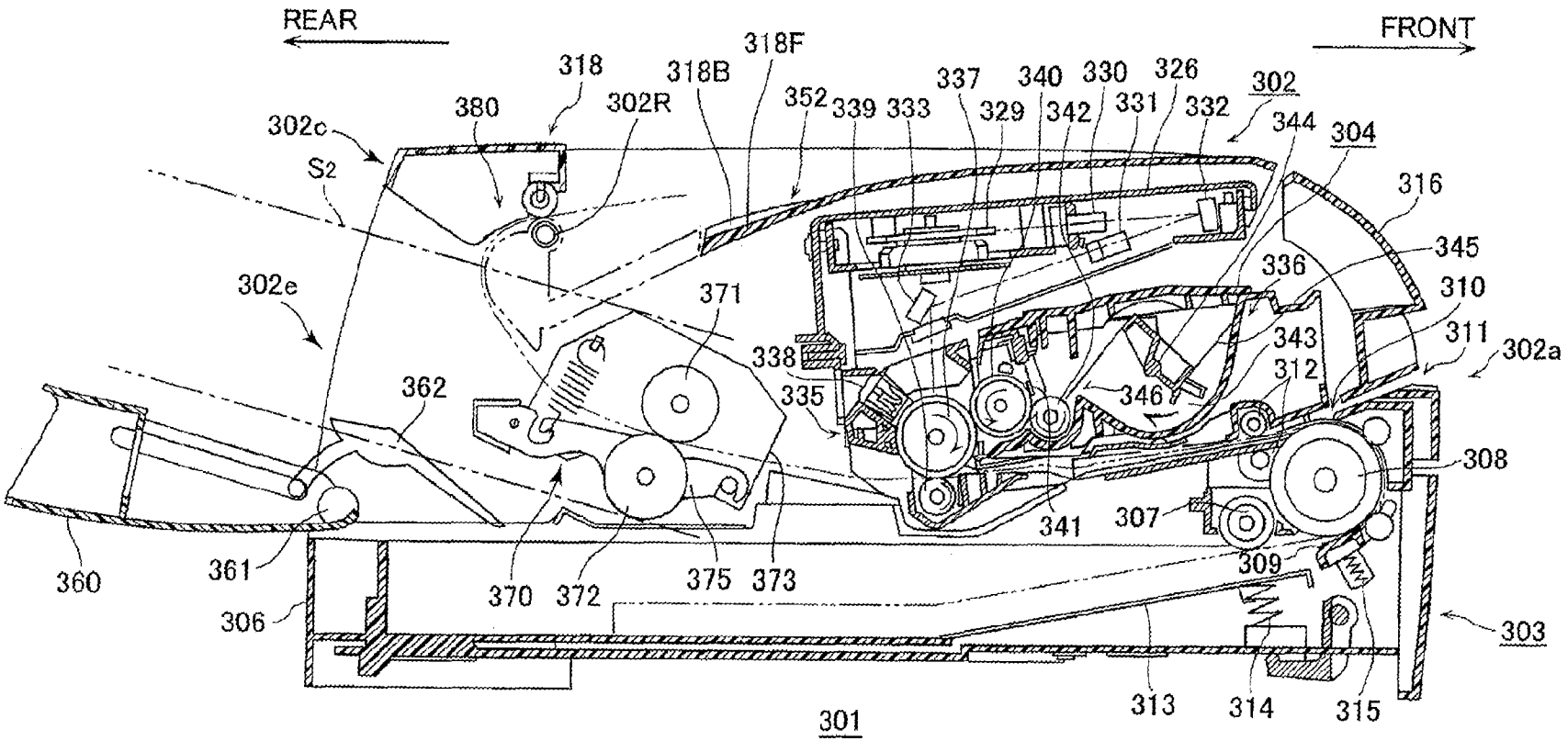
FIG. 17B is a vertical cross-sectional view of the laser printer according to the fourth embodiment for particularly showing a position of a rotational shaft support portion formed on a casing.
Figure 18:
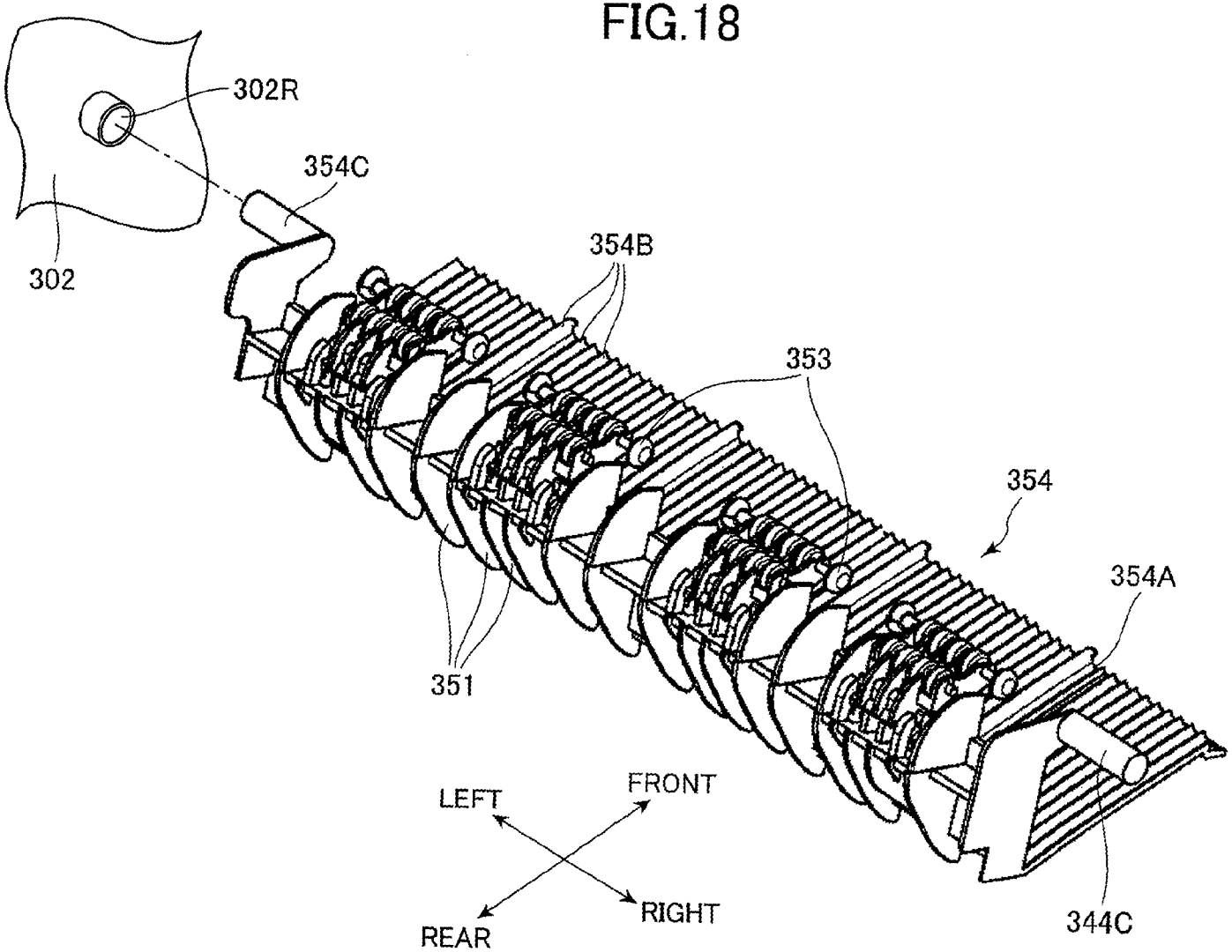
FIG. 18 is a perspective view illustrating the construction of a tray member and the rotational shaft support portion of the laser printer according to the fourth embodiment.

As shown in FIGS. 17B and 18, a rotational shaft support portion 302R is provided on each of the left and right side walls of the casing 302 for rotatably (pivotally) supporting the tray member 354. FIG. 17B shows a position of the rotational shaft support portion 302R in the side wall. As shown in FIG. 18, the rotational shaft support portion is formed as a cylindrical concave portion for receiving a rotational shaft 354C described later. Note that in FIG. 17B the tray member 354 and the inner guide member 351 are omitted and only outlined by the broken line in order to show the rotational shaft support portion 302R. Also in FIGS. 17B and 18, the rotational shaft support portion 302R only on the left side wall is shown.

The paper feed unit 303 includes the paper supply cassette 306; and feeding rollers 307 and 308, and a separating pad 309 disposed above the leading edge of the paper stacked in the paper supply cassette 306 with respect to the paper conveying direction (the front side of the laser printer 301). The paper supply cassette 306 is disposed below the process cartridge 304 and the fixing unit 370 and can be inserted into and removed from the casing 302 through the front side. The paper feed unit 303 turns the direction of the sheet supplied from the paper cassette 306 so that the sheet is conveyed below the process cartridge 304.

A sheet of paper supplied from the paper supply cassette 306 or the manual feed tray 311 is conveyed to registration rollers 312 disposed above the feeding roller 307. The registration rollers 312 first register the sheet and then convey the sheet to an image forming position beneath the process cartridge 304 (a contact position between a photosensitive drum 337 and a transfer roller 339 described later).

A scanning unit 326 is disposed above the process cartridge 304 for scanning the surface of a photosensitive drum 337 disposed in the process cartridge 304 in order to form an electrostatic latent image thereon.

The process cartridge 304 includes a drum cartridge 335 and a developing cartridge 336. The drum cartridge 135 accommodates the photosensitive drum 337, a charger 338, a transfer roller 339, and the like. The developer cartridge 336 is detachably mounted on the drum cartridge 335 and includes a developing roller 340, a thickness regulating blade 341, a supply roller 342, a toner hopper 343, and the like.

In the process cartridge 304, the toner image carried on the surface of the photosensitive drum 337 is transferred onto the paper due to the transfer bias applied to the transfer roller 339, as the sheet of paper passes between the photosensitive drum 337 and the transfer roller 339.

The fixing unit 370 is disposed above the paper supply cassette 306 and to the side and downstream of the process cartridge 304 with respect to the paper conveying direction. After a visible toner image is transferred onto a sheet of paper at the process cartridge 304, the toner image is fixed to the sheet in the fixing unit 370 by the heat of the heating roller 371 as the sheet passes between the heating roller 371 and the pressure roller 372. Subsequently, the heating roller 371 and pressure roller 372 convey the sheet onto a paper discharge path 350 formed in the paper discharge unit 380.

The fixing unit 370 according to the fourth embodiment includes the heating roller 371, and the pressure roller 372 disposed beneath the heating roller 371 and pressing against the surface of the same.

The unit cover 373 covers the upper portion of the heating roller 371. The unit cover 373 is formed (molded) of a resin, such as polyethylene teraphthalate (PET). As shown in FIG. 17A, the unit cover 373 does not cover the entirety of the pressure roller 372 and, hence, part of the pressure roller 372 (a lower portion of the pressure roller 372) is exposed without being covered by the unit cover 373. In the present embodiment, the tray member 354 is disposed at the region above the heating roller 371.

As shown in FIG. 17A, the tray member 354 is fitted in a tray-member mounting opening 318*g* formed in the top cover 318, thereby providing the depressed portion of the sheet discharge tray 352. In this state, part of the tray member 354 (the lowermost portion of the tray member 354) is positioned within a passage S2 through which the fixing unit 370 passes when inserted into or removed from the casing 302 and, hence, prevents the fixing unit 370 from being removed (this position is defined as a first position). More specifically, a lowermost portion 354LM of the tray member 354 is positioned lower than an uppermost portion 370UM of the fixing unit 370. Also, the lowermost portion 354LM of the tray member 354 is positioned closer to the rear side wall 302*c* than the uppermost portion 370UM of the fixing unit 370 is.

A plurality of ribs 318B and 354B are disposed over the entire sheet discharge tray 352 in an orientation parallel to the paper conveying direction. In FIG. 17A, the reference numeral 318B represents ribs provided on the fixed wall portion 318F of the top cover 318, while the reference numeral 354B represents ribs provided on the tray member 354. These ribs facilitate the smooth discharge of paper by reducing the frictional resistance applied to the paper.

An inner guide member 351 is provided on the rear side of the tray member 354. The inner guide member 351 forms part of the paper conveying path P. Lower discharge rollers 353 and upper discharge rollers 355 are arranged in the left-right direction (FIG. 18) and are disposed above the inner guide member 351. Like the first embodiment, the tray member 354 is fitted into the tray-member mounting opening 318*g* such that an upper edge of the tray member 354 on the downstream end in the paper conveying direction (i.e., upper edges of the ribs 354B on the downstream ends) is positioned higher than an upper edge of the fixed wall portion 318F on the upstream end (i.e., upper edges of the ribs 318B on the upstream ends).

With this construction, a step 354S is formed at a contact portion between the tray member 354 and the fixed wall portion 318F. This construction prevents the leading edge of a sheet of paper discharged through the discharge hole from catching on the contact portion, facilitating a smooth discharge of the paper. While the step 354S is visible in FIG. 17A, the actual size of the step 354S need not be this large, as long as the paper is discharged smoothly.

As shown in FIG. 18, the rotational shafts 354C are disposed on the left and right ends of the tray member 354 substantially coaxially with the rotational axis of discharge rollers 353. The rotational shafts 354C are rotatably fitted in the rotational shaft support portions 302R. Accordingly, the tray member 354 is rotatably (pivotally) supported by the casing 302.

The components disposed adjacent to the fixing unit 370, particularly the tray member 354 and the unit cover 373, are preferably formed of a heat-resistant resin because the fixing unit 370 can produce temperatures of 100 degrees Celsius or greater. One example of a heat-resistant material is PC-ABS (a polycarbonate and ABS alloy), but the heat-resistant material is not limited to this material. For example, polybutylene teraphthalate and the like may also be used. After passing through the fixing unit 370, the paper is conveyed toward the paper discharge unit 380.

The paper discharge unit 380 includes an inner guide member 351 described above and an outer guide member 362 that form the paper discharge path 350; the lower discharge rollers 353 and upper discharge roller 355 forming pairs of discharge rollers disposed in a discharge opening through which the paper is discharged onto the sheet discharge tray 352 provided on the top cover 318; and the tray member 354 constituting part of the sheet discharge tray 352. The outer guide member 362 moves in association with the opening and the closing of the rear cover 360 provided on the rear side wall 302*c* of the casing 302. The rear cover 360 is attached to the casing 302 via a hinge 361 and is capable of swinging open and closed about the hinge 361. When the rear cover 360 is swung to an open position, the top portion of the outer guide member 362 pivots rearward in association. In this way, the paper discharge path 350 can be exposed through an opening 302*e* formed in the rear side wall 302*c* by opening the rear cover 360.

Figure 19:
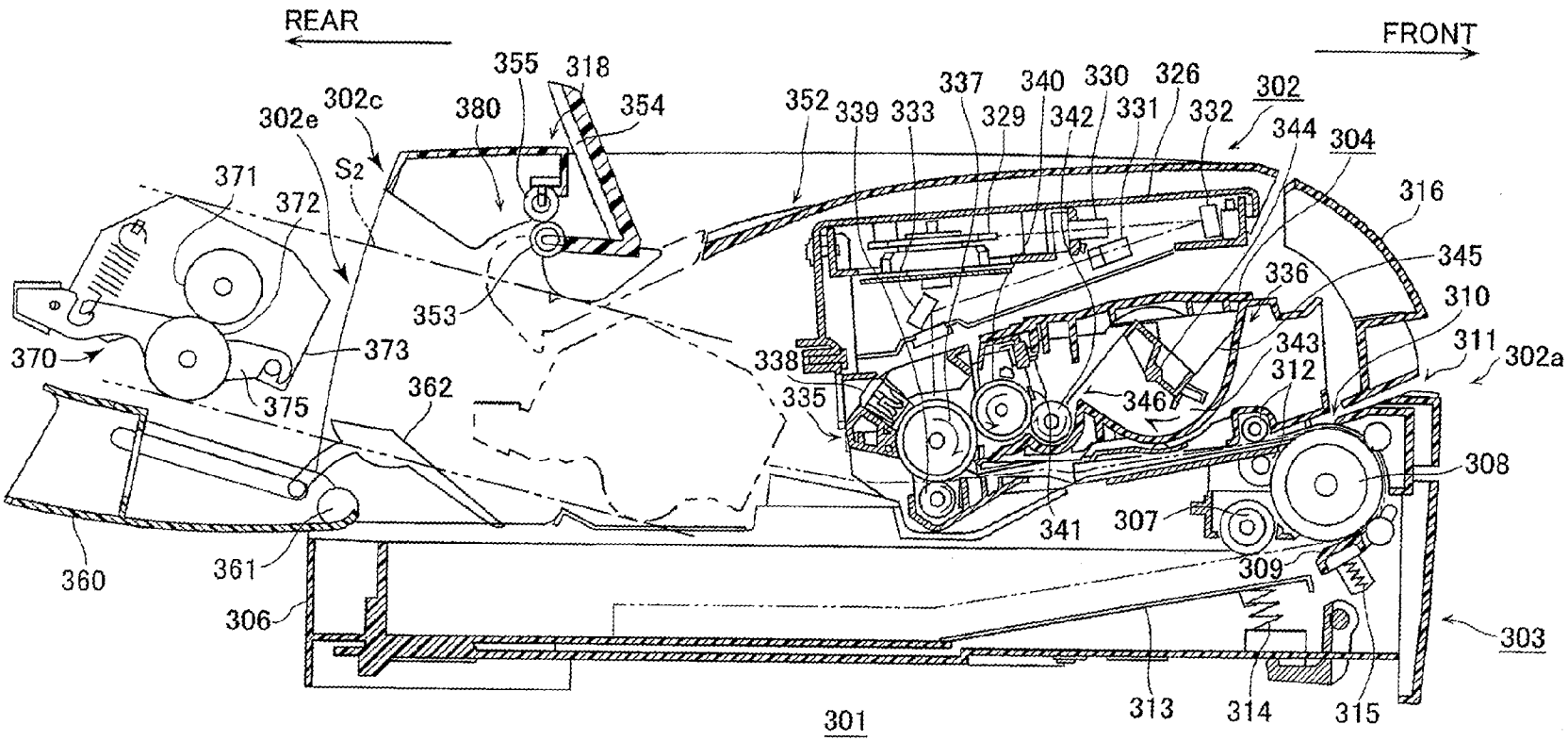
FIG. 19 is a vertical cross-sectional view showing the laser printer according to the fourth embodiment when a fixing unit has been removed.

After passing through the paper discharge unit 380, the sheet of paper is discharged into the sheet discharge tray 352, thus completing the printing operation. As shown in FIG. 19, when the rear cover 360 is in an open state, the fixing unit 370 can be removed through the opening 302*e* formed in the rear side wall 302*c*. The procedure for removing the fixing unit 370 will be described below in detail.

As shown in FIG. 17A, the user first opens the rear cover 360 in order to remove the fixing unit 370. The outer guide member 362 pivots rearward together with the rear cover 360 as the rear cover 360 is opened. This operation creates the opening 302*e* through which the fixing unit 370 is removed.

However, when the tray member 354 is disposed in the first position (FIG. 17A), the lowermost portion of the tray member 354 is positioned within the passage S2 through which the fixing unit 370 passes when inserted into or removed from the casing 302 and, hence, prevents the fixing unit 370 from being removed. Accordingly, the tray member 354 is rotatably moved to a position outside the passage S2 (FIG. 19). This position is defined as a second position.

In order to move the tray member 354 from the first position to the second position, the tray member 354 is rotated counterclockwise in FIG. 17A about the rotational shafts 354C to reach the second position (FIG. 19).

Next, the fixing unit 370 is pulled through the passage S2 until completely removed from the casing 302.

Further, the fixing unit 370 and the tray member 354 are easily returned to their original positions (mount positions) by performing the procedure described above in reverse.

In the laser printer 301 according to the fourth embodiment described above, the fixing unit 370 can be removed while the tray member 354 is engaged in (or, supported by) the casing 302. Hence, it is not necessary to remove the tray member 354 in order to remove the fixing unit 370, thereby preventing loss of the tray member 354 that might occur when the tray member 354 is detached. Since the tray member 354 can be moved to the second position simply by rotating the tray member 354, the procedure for removing the fixing unit 370 is easily performed. Further, the fixing unit 370 can be disposed below and adjacent to the sheet discharge tray 352, enabling the device to be made more compact (in particular, the height can be reduced).

<Modification>

While the invention has been described in detail with reference to the specific embodiment thereof, it would be apparent to those skilled in the art that various changes and modifications may be made therein without departing from the spirit of the invention.

For example, in the first embodiment described above, the tray member 54 that configures a portion of the sheet discharge tray 52 is formed integrally with the inner guide member 51. However, the tray member 54 and the inner guide member 51 may instead be configured separately.

Further, the rear cover 60 is configured separately from the outer guide member 62, while the outer guide member 62 pivots rearward in association with the rear cover 60 when the rear cover 60 is opened. However, the outer guide member 62 and the rear cover 60 may instead be formed integrally.

In the second embodiment described above, the tray member 154 and the fixing unit 170 (the combined unit) are removed as a unit (FIG. 11). However, since a protruding portion 154P of the tray member 154 protrudes outward (in the front-upper direction) from the fixing unit 170, the protruding portion 154P can contact other components in the casing 102 when the combined unit is being removed, making it difficult to remove the combined unit. Accordingly, the protruding portion 154P may be configured to be bendable toward the fixing unit 170 at a bending point B in FIG. 11. With this construction, the protruding portion 154P is less likely to contact other components in the casing 102 when removing the combined unit, thereby facilitating removal of the same.

In the third and fourth embodiments described above, engaging groove portions and rotational shaft support portions are provided on the casing, but these portions may instead be provided on the tray member. In this case, the engaging protruding portions and rotational shafts are provided on the casing.

Figure 20:
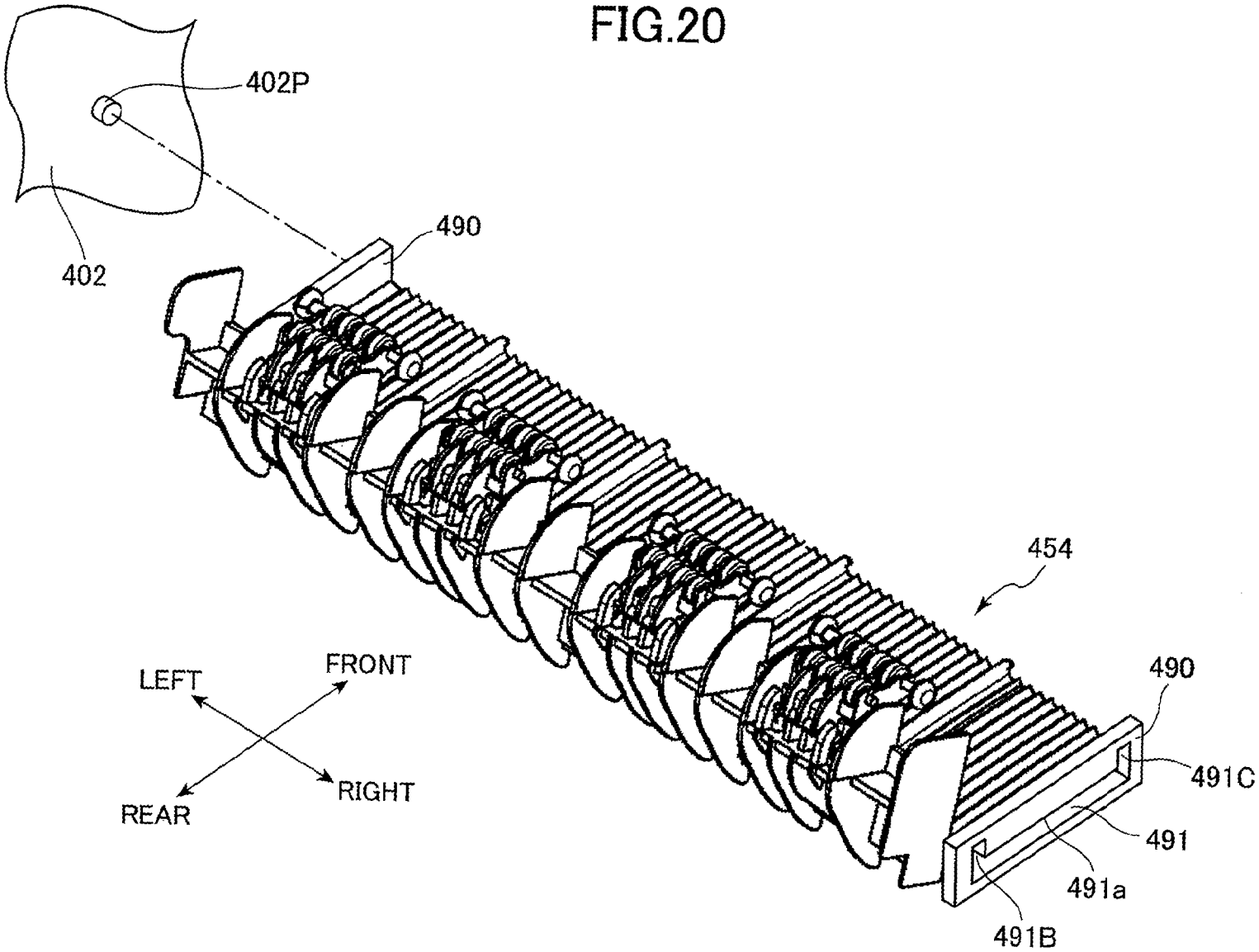
FIG. 20 is a perspective view illustrating the construction of a tray member and an engaging protruding portion provided on a casing according to a modification.

For example, with a modification shown in FIG. 20, plate members 490 are provided at left and right ends of a tray member 454, and engaging groove portions 491 (only the right side one is shown in FIG. 20) are formed on the plate members 490. Each engaging groove portion 491 has a support surface 491*a* that is an upper surface inside the engaging groove portion 491. Also, engaging protruding portions 402P (only the left side one is shown in FIG. 20) are provided on left and right side walls of a casing 402. The engaging protruding portions 402P are fitted in the engaging groove portions 491 and are slidingly movable within the same. In this modification, however, the engaging protruding portions 402P do not move actually, but move relative to the engaging groove portions 491. The support surfaces 491*a* are supported by the engaging protruding portions 402P. Each engaging groove portion 491 includes step portions 491B and 491C that are formed at rear and front ends of the engaging groove portion 491. With this construction, when the tray member 454 is positioned at the first position (FIG. 20), each engaging protruding portions 402P is positioned at the step portion 491C. When the tray member 454 slidingly moves from the first position to the second position, each engaging protruding portion 402P slides on the support surface 491*a* from the step portion 491C to the step portion 491B.

In the third embodiment described above, the tray member is slid from the first position to the second position, while in the fourth embodiment the tray member is rotated from the first position to the second position. However, the image forming device may be configured so that the tray member is initially slid from the first position and subsequently rotated to the second position, for example.

In the third and fourth embodiments described above, the tray member is moved from the first position to the second position while in constant engagement with the casing. However, the image forming device may be configured such that a tray member may also be moved from the first position to the second position while detached (disengaged) from the casing. In this case, by providing, on the casing, a tray member placing portion for placing or fixing the tray member in the second position, the tray member is not separated from the casing and is not lost. Further, when there is little or no space available around the installation area, the tray member placing portion improves operability of a removing operation of the fixing unit.

What is claimed is:

1. An image forming device comprising:

a casing having a top wall and side walls, the side walls including a front side wall and a rear side wall opposite to each other, the top wall being positioned at a top of the casing when the casing is disposed in an orientation corresponding to an intended operation state of the image forming device;

a process cartridge including an image bearing member that bears a toner image thereon;

a scanning unit that exposes the image bearing member to scanned light; and a fixing unit including a fixing roller that extends in an axial direction and that fixes the toner image transferred from the image bearing member onto a recording medium, the front side wall and the rear side wall each extending in a direction substantially parallel to the axial direction, the fixing unit being disposed at a mount position closer to the rear side wall than to the front side wall, wherein the top wall is formed with a depressed portion depressed toward inside the casing, the depressed portion configured to be a sheet discharge tray for receiving the recording medium that has passed through the fixing unit, the sheet discharge tray including a tray member disposed at a predetermined position at the top wall, wherein the rear side wall is formed with an opening through which the fixing unit is removed, wherein, when the tray member is disposed at the predetermined position, the tray member is positioned above and adjacent to the fixing unit and overlaps the fixing unit when viewed through the opening to prevent the fixing unit from being removed from the casing, and wherein the fixing unit is removable through the opening when the tray member is moved from the predetermined position.

2. The image forming device as claimed in claim 1, wherein the tray member is formed integrally with the fixing unit to form a combined unit, and wherein the combined unit is removable from the casing through the opening.

3. The image forming device as claimed in claim 1, wherein the fixing roller includes a heating roller and a pressure roller disposed in contact with each other, wherein the fixing unit further includes a unit cover that covers the heat roller and that rotatably supports the heat roller, and wherein the unit cover and the tray member are formed integrally from a resin.

4. The image forming device as claimed in claim 3, wherein the resin is heat-resistant.

5. The image forming device as claimed in claim 1, wherein the casing includes a cover swingably disposed at the rear side wall for covering the opening.

6. The image forming device as claimed in claim 1, further comprising an inner guide member forming a recording medium conveying path through which the recording medium is conveyed in a conveying direction, the inner guide member being disposed at a position downstream of the fixing unit in the conveying direction, the inner guide member being exposed from outside the casing through the opening.

7. The image forming device as claimed in claim 6, wherein the inner guide member is removable from the casing through the opening.

8. The image forming device as claimed in claim 6, wherein the top wall is formed with a tray-member mounting opening, and wherein the tray member is fitted in the tray-member mounting opening and forms part of the depressed portion, the inner guide member being formed integrally with the combined unit.

9. The image forming device as claimed in claim 1, wherein the top wall is formed with a tray-member mounting opening;

wherein the tray member is fitted in the tray-member mounting opening and forms part of the depressed portion, wherein the top wall includes a fixed wall portion fixedly provided at the casing and positioned downstream of the tray member in a conveying direction in which the recording medium is conveyed, wherein the tray member has a downstream end in the conveying direction, and the fixed wall portion has an upstream end in the conveying direction that is adjacent to the downstream end, and wherein an upper edge of the downstream end is positioned higher than an upper edge of the upstream end.

10. The image forming device as claimed in claim 1, further comprising a plurality of ribs disposed on top of the sheet discharge tray in an orientation parallel to a conveying direction in which a recording medium is conveyed.

11. The image forming device as claimed in claim 1, further comprising a paper supply cassette disposed below the fixing unit for accommodating stacked sheets of recording medium, wherein a recording medium supplied from the paper supply cassette is conveyed through a recording medium conveying path provided above the paper supply cassette and below the process cartridge.

12. The image forming device as claimed in claim 11, wherein the paper supply cassette is removable from the casing through the front side wall.

13. The image forming device as claimed in claim 1, wherein the front side wall is formed with a front side opening, and wherein the process cartridge is removable from the casing through the front side opening.

14. The image forming device as claimed in claim 1, wherein the fixing unit is removed from the casing along a fixing unit removing passage, the fixing unit removing passage being provided in the casing from the mount position to the opening, and wherein the tray member is movable between a first position serving as the predetermined position and a second position, in the first position at least part of the tray member being positioned in the fixing unit removing passage to prevent the fixing unit from being removed from the casing, and in the second position the tray member being positioned outside the fixing unit removing passage to allow the fixing unit to be removed from the casing along the fixing unit removing passage.

15. The image forming device as claimed in claim 14, wherein the tray member is movable between the first position and the second position while being supported by the casing.

16. The image forming device as claimed in claim 15, wherein a lowermost portion of the tray member is positioned lower than an uppermost portion of the fixing unit when the tray member is in the first position; and wherein the lowermost portion of the tray member is positioned higher than the uppermost portion of the fixing unit when the tray member is in the second position.

17. The image forming device as claimed in claim 15, wherein one of the tray member and the casing has a rotational shaft, and the other of the tray member and the casing is formed with a rotational shaft support portion that rotatably supports the rotational shaft to allow the tray member to be rotatably supported by the casing.

18. The image forming device as claimed in claim 15, wherein one of the casing and the tray member has a protruding portion, and the other of the tray member and the casing is formed with a groove portion that slidably supports the protruding portion to allow the tray member to be slidably supported by the casing.

19. The image forming device as claimed in claim 18, wherein the groove portion is configured to guide the tray member in an upward direction and then guide the tray member in a direction intersecting with the upward direction.

20. The image forming device as claimed in claim 18, wherein the tray member has the protruding portion, and the casing is formed with the groove portion;

wherein the groove portion includes a support surface that is provided inside the groove portion and that supports the protruding portion, and wherein the groove portion includes a first step portion and a second step portion provided on the support surface, the first step portion and the second step portion being spaced away from each other in a sliding direction in which the protruding portion slides.

21. The image forming device as claimed in claim 18, wherein the casing has the protruding portion, and the tray member is formed with the groove portion, wherein the groove portion includes a support surface that is provided inside the groove portion and that is supported by the protruding portion, and wherein the groove portion includes a first step portion and a second step portion provided on the support surface, the first step portion and the second step portion being spaced away from each other in a sliding direction in which the protruding portion slides.

22. The image forming device as claimed in claim 14, wherein the casing includes a cover swingably disposed at the rear side wall for covering the opening.

23. The image forming device as claimed in claim 14, further comprising an inner guide member forming a recording medium conveying path through which the recording medium is conveyed in a conveying direction, the inner guide member being disposed at a position downstream of the fixing unit in the conveying direction, the inner guide member being exposed from outside the casing through the opening.

24. The image forming device as claimed in claim 23, wherein the inner guide member is removable from the casing through the opening.

25. The image forming device as claimed in claim 23, wherein the top wall is formed with a tray-member mounting opening, and wherein the tray member is fitted in the tray-member mounting opening and forms part of the depressed portion, the tray member being formed integrally with the inner guide member.

26. The image forming device as claimed in claim 14, wherein the top wall is formed with a tray-member mounting opening;

wherein the tray member is fitted in the tray-member mounting opening and forms part of the depressed portion, wherein the top wall includes a fixed wall portion fixedly provided at the casing and positioned downstream of the tray member in a conveying direction in which the recording medium is conveyed, wherein the tray member has a downstream end in the conveying direction, and the fixed wall portion has an upstream end in the conveying direction that is adjacent to the downstream end, and wherein an upper edge of the downstream end is positioned higher than an upper edge of the upstream end.

27. The image forming device as claimed in claim 14, wherein the tray member is made from a heat-resistant resin.

28. The image forming device as claimed in claim 14, further comprising a plurality of ribs disposed on top of the sheet discharge tray in an orientation parallel to a conveying direction in which a recording medium is conveyed.

29. The image forming device as claimed in claim 14, further comprising a paper supply cassette disposed below the fixing unit for accommodating stacked sheets of recording medium, wherein a recording medium supplied from the paper supply cassette is conveyed through a recording medium conveying path provided above the paper supply cassette and below the process cartridge.

30. The image forming device as claimed in claim 29, wherein the paper supply cassette is removable from the casing through the front side wall.

31. The image forming device as claimed in claim 14, wherein the front side wall is formed with a front side opening; and wherein the process cartridge is removable from the casing through the front side opening.

32. A method for removing a fixing unit from an image forming device including a casing having a top wall and side walls, the side walls including a front side wall and a rear side wall opposite to each other, the top wall being positioned at a top of the casing when the casing is disposed in an orientation corresponding to an intended operation state of the image forming device;

a process cartridge including an image bearing member that bears a toner image thereon;

a scanning unit that exposes the image bearing member to scanned light; and a fixing unit including a fixing roller that extends in an axial direction and that fixes the toner image transferred from the image bearing member onto a recording medium, the front side wall and the rear side wall each extending in a direction substantially parallel to the axial direction, the fixing unit being disposed at a mount position closer to the rear side wall than to the front side wall, wherein the top wall is formed with a depressed portion depressed toward inside the casing, the depressed portion configured to be a sheet discharge tray for receiving the recording medium that has passed through the fixing unit, the sheet discharge tray including a tray member disposed at a predetermined position at the top wall, wherein the rear side wall is formed with an opening through which the fixing unit is removed, and wherein, when the tray member is disposed at the predetermined position, the tray member is positioned above and adjacent to the fixing unit and overlaps the fixing unit when viewed through the opening to prevent the fixing unit from being removed from the casing, the method comprising:

moving the tray member from the predetermined position; and removing, after the moving step, the fixing unit from the casing through the opening.

33. The method as claimed in claim 32, wherein the tray member is formed integrally with the fixing unit to form a combined unit, and wherein the moving and removing steps comprise removing the combined unit from the casing through the opening.

34. The method as claimed in claim 32, wherein the tray member is movable between a first position serving as the predetermined position and a second position, in the first position at least part of the tray member is positioned in the fixing unit removing passage to prevent the fixing unit from being removed from the casing, and in the second position the tray member is positioned outside the fixing unit removing passage to allow the fixing unit to be removed from the casing along the fixing unit removing passage, and, wherein the moving step comprises moving the tray member from the first position to the second position.

* * * * *